US009873033B2

(12) United States Patent
Debney

(10) Patent No.: US 9,873,033 B2
(45) Date of Patent: Jan. 23, 2018

(54) SNOWBOARD COMBINATION BOOT AND BINDING SYSTEM

(76) Inventor: Ben C Debney, West Linn, OR (US)

( * ) Notice: Subject to any disclaimer, the term of this patent is extended or adjusted under 35 U.S.C. 154(b) by 1305 days.

(21) Appl. No.: 15/330,494

(22) PCT Filed: Oct. 27, 2011

(86) PCT No.: PCT/US2011/058123

§ 371 (c)(1),
(2), (4) Date: Mar. 20, 2017

(87) PCT Pub. No.: WO2012/058451

PCT Pub. Date: May 3, 2012

(65) Prior Publication Data

US 2017/0216710 A1 Aug. 3, 2017

Related U.S. Application Data

(60) Provisional application No. 61/407,094, filed on Oct. 27, 2010.

(51) Int. Cl.

| | |
|---|---|
| ***A63C 9/08*** | (2012.01) |
| ***A63C 10/10*** | (2012.01) |
| ***A43B 5/04*** | (2006.01) |
| ***A43B 7/12*** | (2006.01) |
| ***A43B 13/04*** | (2006.01) |
| ***A43B 23/02*** | (2006.01) |
| ***A43C 11/00*** | (2006.01) |

(Continued)

(52) U.S. Cl.

CPC ..... *A63C 10/103* (2013.01); *A43B 5/0401* (2013.01); *A43B 5/0423* (2013.01); *A43B 5/0482* (2013.01); *A43B 7/12* (2013.01); *A43B 13/04* (2013.01); *A43B 23/0265* (2013.01); *A43C 11/008* (2013.01); *A43C 11/16* (2013.01); *A63C 5/03* (2013.01); *A63C 5/031* (2013.01); *A63C 2203/06* (2013.01)

(58) Field of Classification Search

CPC ..... A63C 9/086; A63C 9/0846

See application file for complete search history.

(56) References Cited

U.S. PATENT DOCUMENTS 4,177,584 A * 12/1979 Beyl ..... A43B 5/0417 280/613

5,520,406 A * 5/1996 Anderson ..... A63C 10/10 280/14.24

(Continued)

*Primary Examiner* — Bryan A Evans

(74) *Attorney, Agent, or Firm* — Mohr Intellectual Property Law Solutions, P.C.

(57) ABSTRACT

The present invention contemplates a binding system for a snowboards and the like. The system includes a soft-soled boot having a hardened exterior shell consisting of a toe portion and a heel portion, which are linked by at least one sidewall portion. The toe and heel portions include two toe and two heel pegs respectively. The boot includes an instep portion having instep cables for adjusting the boot to the wearer and the cables are adjusted by grommets and tightened in position by at least one resting bar. The binding has a base plate for connecting to the snowboard. The base plate further supports a pair of toe hooks adapted to engage the toe pegs and a pair of heel peg levers adapted to releasably engage the heel pegs of the boot. A grappling hook and ratchet mechanism grabs the resting bar on the boot.

12 Claims, 14 Drawing Sheets

(51) Int. Cl.
*A43C 11/16* (2006.01)
*A63C 5/03* (2006.01)

(56) References Cited

U.S. PATENT DOCUMENTS 6,189,913 B1 * 2/2001 Morrow ..... A43B 5/0401
280/14.21
6,226,897 B1 * 5/2001 Sand ..... A43B 5/0401
36/107

* cited by examiner

FIG. 2
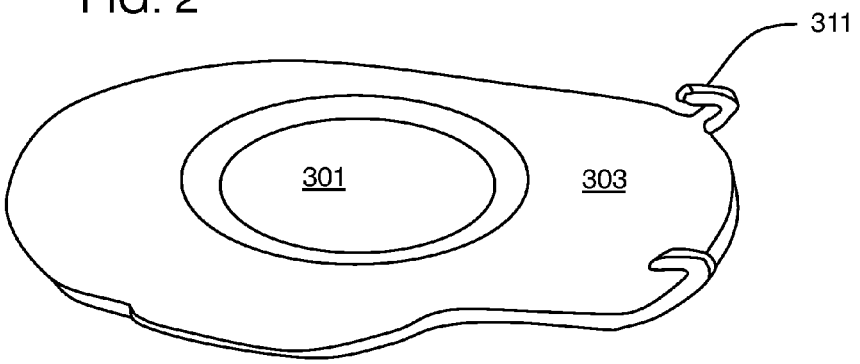
FIG. 4A
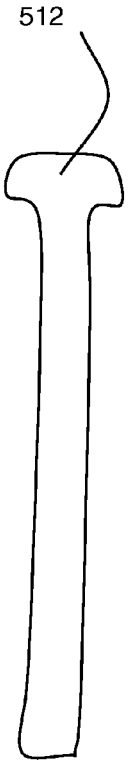
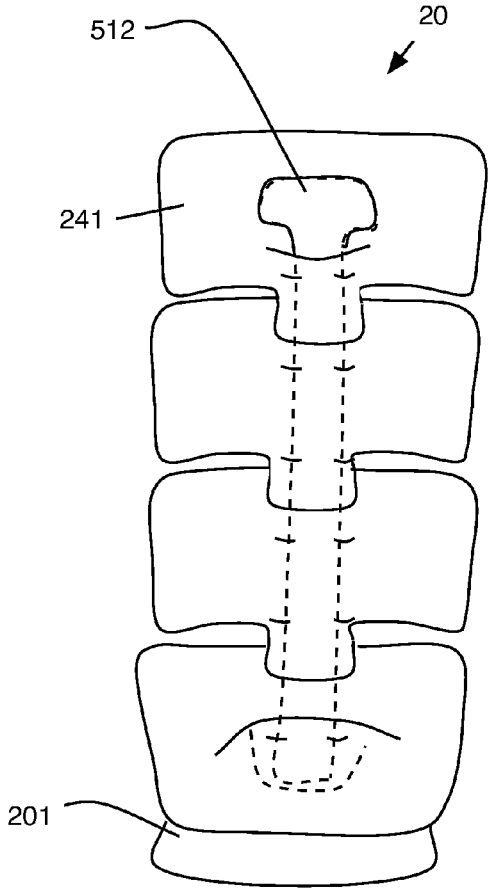
FIG. 4

20
40
311
311
312
312
314
315
316

317
315
311
Support
Tubular Lade
Padding

SNOWBOARD COMBINATION BOOT AND BINDING SYSTEM

PRIORITY CLAIM

This present application claims benefit under 35 U.S.C. Section 119(e) of U.S. Provisional Patent Application Ser. No. 61/407,094 filed on 27 Oct. 2010, the disclosure of which is expressly incorporated by reference for all purposes.

BACKGROUND

The present invention relates to boots and binding systems for snowboards.

Conceptually, the snowboard may be thought of as a flat planar object that floats on top of a layer of snow. It is most affectively used on an inclined plane having a low friction coefficient (i.e. mountain covered with snow). Snowboard riders summit a, preferably, steep inclined plane—whether by chair lift, hiking, helicopter, or other known means for summiting a mountain. This creates potential energy based on the mass of the rider (and gear and snowboard) and the vertical elevation traversed to summit the mountain. The physics of this is well understood, and the joy of riding a snowboard is a result of converting this potential energy into kinetic energy by riding the board down the slope (inclined plane).

The board moves quickly down the hill because a very low friction surface is created by the mass of the board and rider and gear sitting on top of the snow. This weight and friction between the board and the snow melts a fine layer of the snow and it is this thin film of water that provides the reduced friction necessary for the board to careen down the mountain. This water is present throughout the length of the board (or at least the length of it that's in contact with the snow) and when the rider is coasting down the mountain she is actually coasting on a very thin film of water. The (skilled) rider controls the speed and direction of the board by tilting the board left and right and fore and aft. This movement is termed "shredding". Shredding, or shifting the rider's weight, thus moving the board from one edge to the other also requires careful control of the center of gravity over the edge of the board that is in contact with the snow. If the rider fails to do so, the most common experience is to land on their back or front (depending on which board edge they are switching to). From this, it can be appreciated that the rider is controlling the contact area (increasing or reducing the frictional contact area resulting in decreased or increased acceleration) and steering the board.

To slow down and turn, a boarder 'digs' into the snow with the riding edge and leans in the direction they want to move. The larger amount of snow and the force of gravity create a set of forces whose net force push the board in the direction desired by the rider. Not surprising, the type of boot and binding system utilized to connect the rider to the board has significant influence on the quality and comfort of the ride and the performance and control of the board.

To enable a rider to control the board, various mounting systems and boots have been designed and are known in the prior art. Broadly categorized, these binding systems can be organized into rigid boots and associated binding system or soft boots and their associated binding systems.

Rigid and Soft Boots for Snowboards:

A snowboard is controlled by weight transfer and foot movement, both left to right (lateral) and fore and aft (longitudinal). Precision edge control is especially important in snowboarding activities where carving, rather than sliding, through the snow is desirable. Rigid boots are therefore highly desirable because they can transfer small movements of the rider's foot more directly to the board. However, boot flexibility is also important for many recreational and freestyle snowboarding activities, where "feel" is important and, thus, a more flexible boot is desired.

Balancing these two opposing characteristics has resulted in a myriad of boot and binding designs. For example, to provide control, mountaineering-type boots including a molded plastic, stiff outer shell and a soft inner liner, have been very popular. The boots are mounted on the snowboard using mountaineering or plate bindings. Plate bindings are fastened to the board under the fore and aft portions of the sole of the boot and typically provide both heel and toe bails to secure the boot in place, usually without any safety release mechanism. These boots are stiff enough to provide the desired edge control and stability for carving. However, they are too stiff to allow significant lateral flexibility, a key movement in the sport that is essential for freestyle enthusiasts and desirable for all-around snowboarders. As a result, the mountaineering-type boots feel too constraining to many snowboarders.

Freestyle snowboarding requires more flexibility of the ankle of the snowboarder relative to the board than the mountaineering-type boots allow. The mountaineering-type boots offer little lateral flexibility and only marginal fore and aft flexibility. To overcome this lack of flexibility, many riders utilize a soft-shell binding with an insulated snow boot. These bindings have rigid bases attached to the board, highback shells, straps to wrap around the boot, and buckles to secure the straps in place. The boots are standard insulated snow boots or slightly modified snow boots. The flexibility gained from the soft boot and relatively soft binding results in less edge control than a mountaineering-type boot. To gain more edge control, riders of soft-shell and snow boot systems over-tighten the binding straps around the boots. This over-tightening seriously sacrifices comfort.

Plate-Type Binding Systems for Snowboards:

Plate-type binding systems attach a boot by front and heel clips affording very firm seating of the boot on the board. One such plate-type binding system, described by Ratzek in U.S. Pat. No. 5,236,216 issued on 1993 Aug. 17 includes a rotatable base plate mounted directly in contact with the top surface of the snowboard. The base plate includes a circular central opening with a circular fastening disc formed with a projecting rim extending over the opening.

Ratzek et al. further teaches a rigid boot design for the plate-type binding system (of U.S. Pat. No. 5,236,216 issued on 1993 Aug. 17, discussed above) in U.S. Pat. No. 5,697,631 issued on 1997 Dec. 16. This boot design includes a snowboard binding having a sole part integrated in the boot and a first binding element cooperating with it and continuously connected to the snowboard. The sole part has two spring-loaded pins projecting laterally out of the sole part and capable of engaging with an opening of the first binding element. The pins can be retracted with a device attached to the snowboard boot to selectively open the binding.

Dodge, in U.S. Pat. No. 6,354,610 issued on 2002 Mar. 12, discloses a snowboard boot including at least one recess adapted to mate with a corresponding engagement member on a plate binding, and an interface for interfacing a snowboard boot to a binding. The interface comprises a body having at least one recess arranged to be disposed along an outer surface of the snowboard boot, the recess being adapted to mate with a corresponding engagement member on the binding.

Anderson et al., in U.S. Pat. No. 6,705,634 issued 2004 Apr. 16, describe an improved mounting system for connecting the solo of a boot to a plate-type binding device for a snowboard. The system includes first and second boot mounted bales in the form of rigid loops that extend from each side of the boot soles, and a pair of bindings attached to the snowboard. Each binding has a base including elongated, slotted holes located on the circumference of a circle through which bolts are placed to secure the base to the snowboard with a friction washer. The elongated holes allow for rotational adjustment of the binding. A hook-shaped structure extends from one side of the base with the hook facing outward. On the opposite side of the base is a cam structure with a downward and outwardly sloping surface ending in a bale-receiving notch. A spring loaded latch is pivotally mounted outboard and above the notch and includes a lever with a generally outwardly protruding handle on one side of the lever pivot axis, and a bale latching portion on the other side of the pivot.

Strap-in and Step-in Bindings for Soft Boots:

Early soft-boot binding systems simply attempted to affix a normal snow boot to the board using heel and toe strap members, augmented with some semi-rigid support device that guided the heel or toe or both ends of a common snow boot. These systems are generally known as strap-in systems and require the user to tighten a strap at the toe end. One exemplary strap-in type binding for snowboards includes a base plate with a pivotably connected high back member, a toe strap and instep strap, as taught by Laughlin in U.S. Pat. No. 5,692,765 issued on 1997 Dec. 2. And as further disclosed by Laughlin in U.S. Pat. No. 6,102,429 issued on 2000 Aug. 15 and U.S. Pat. No. 6,123,354 issued on 2000 Sep. 26 and U.S. Pat. No. 6,270,110 issued on 2001 Aug. 7 and U.S. Pat. No. 6,648,365 issued on 2003 Nov. 18 and U.S. Pat. No. 6,758,488 issued 2004 Jun. 6 and U.S. Pat. No. 6,899,349 issued 2005 May 31.

Laughlin et al. teaches yet another version of a highback support device for a soft-boot binding in U.S. Pat. No. 6,554,296 issued on 2003 Apr. 29 and U.S. Pat. No. 6,736,413 issued 2004 May 18. The highback is comprised of an upright support member including at least two portions that are to be contacted by and to support a rear portion of the rider's leg and that are movable relative to each other for setting a desired forward lean of the highback. The support member may include a lower portion with a pair of mounting locations for mounting the highback to a gliding board component, such as a snowboard binding, and an upper portion movably supported by the lower portion to vary the forward lean of the highback. The highback may include a forward lean adjuster that that prevents the upper portion from moving in the heel direction beyond a predetermined forward lean position. The forward lean adjuster may be coupled to the upper portion and the lower portion of the highback to maintain the upper portion in the selected forward lean position independent of the gliding board component. A ride/relax feature may be provided to allow a rider to place the highback in either a ride mode in which the highback is fixed in the preselected forward lean position or a relax mode in which the highback is unrestrained so that leg movement is permitted in the heel direction beyond the forward lean position. A locking arrangement may also be provided to lock the highback in an upright riding position to prevent toe-edge travel relative to the board for enhanced board response.

Another conventional strap-in binding device, described by Couderc in App. No. US 2005/0167933 published on 2005 Aug. 4, includes a base plate associated with a rear support element highback. The rear support element is movably mounted with respect to the base plate. A linkage is connected to the base plate and to the rear support element in order to limit the rearward movement thereof. The position of the rear support element with respect to the base plate is longitudinally adjustable.

Yet another approach to a dual-strap binding includes the system of Muscatelli published on 2007 Aug. 16 in Pub. No. US 2007/0187928. Therein, a binding, in particular a snowboard binding comprises a base plate; a heel-cradling element; a toe-cradling element; an instep-strapping arrangement having a long part connected to one side of the base plate and a short side part connected to the other side; a closure device for the instep strapping arrangement; and a flexible linkage connecting the closure device of the instep-strapping arrangement and the toe-cradling element. In an open position the toe-cradling element is free to move, and in a closed position the flexible linkage pulls the toe-cradling element, so the foot is secured between the toe-cradling element, the heel-cradling element and the instep-strapping arrangement. In this closed position the held-together parts of the instep-strapping arrangement hold a foot securely by forces acting between these parts through the closure device, independently of the need to maintain tension in the flexible linkage.

Yet another strap-in binding includes the adjustable toe portion binding relative to the heel portion of a binding system as described by Zaloom et al. in Pub. No. US 2008/0030000 published on 2008 Feb. 7.

Warburton et al., in Pub. No. US 2008/0116664 published on 2008 May 22, describe a snowboard binding for securing a boot to a snowboard having a base mounted to the snowboard. The base includes a base plate and a pair of side rails that extend upwardly from the base plate along lateral sides of the base plate. The snowboard binding further includes a high-back support secured to the pair of side rails. The high-back support is fabricated from a single piece of material and has a hinge formed therein to adjust a forward lean position of the high-back support. Pontano et al., in Pub. No. US 2009/01345602 published on 2009 May 28, enhance the Warburton device by including a ratcheting strap assembly and a lateral toe wall on the base plate.

A strap-in binding that provides step-in convenience includes the device of Poscich described in U.S. Pat. No. 6,705,633 issued on 2004 Mar. 16 and U.S. Pat. No. 6,722,688 issued 2004 Apr. 20 and U.S. Pat. No. 6,726,238 issued 2004 Apr. 27. Poscich describes a plate attached to the board with slots for mating pegs provided by the boot. This laterally and longitudinally fixes the sole of the boot relative to the board. Strap members at the toe and mid-foot/ankle conventionally secure the boot in the binding system.

Martin describes a snowboard binding engagement mechanism in U.S. Pat. No. 7,246,811 issued on 2007 Jul. 24. Similar to other strap-in bindings known in the art, Martin's binding includes a base plate with a highback pivotally attached. A locking lever disposed on the back of the highback locks the highback in a generally upright position with a desired maximum forward lean. A flexible member such as a strap, panel, cord guide and cord attached to the highback and to the locking lever facilitates moving the lever between an open position and a locked position.

Sand et al., in U.S. Pat. No. 5,966,843 issued on 1999 Oct. 19, teaches an improved soft style snowboard boot that is internally reinforced by a multi-piece boot support assembly that includes a rigid molded plastic shank portion, a semi-rigid molded heel cup portion, and a molded or die-cut plastic highback portion. The shank portion is designed to resist flex, and provide ergonomic support for the foot, and further includes molded-in features which permit positive mechanical fastening of conventional step-in binding attachment structure, to the outsole of the boot. A pair of length adjustable tensioning strap members is connected between the shank and highback portions and when tightened the straps induce a desired forward lean in the highback portion. The straps may be tightened independently of each other to provide a desired side bias, left or right, to the highback portion.

Yet another step-in binding, described by Moe in U.S. Pat. No. 6,007,077 issued 1999 Dec. 28, teaches a step-in snowboard binding having a base assembly, which is adjustably attached to the snowboard at an angle that is selected by the user. A front assembly and a back assembly are pivotally carried by the base assembly and are pivotally connected to each other. The front and back assemblies pivot between a closed and locked boot-restraining position, and an open step-in/out position. The front assembly carries an adjustable toe strap and an adjustable foot strap. A fastening assembly releasably locks the front and back assemblies together in the closed boot-restraining position.

Yet another modification to the step-in binding, taught by Sand et al. in U.S. Pat. No. 6,082,026 issued on 2000 Jun. 4, supports ankle region of a conventional soft boot. The assembly includes a rigid heel cup and a high back support for supporting the calf region of the snowboard rider. The high back support includes an extension member having a bottom end portion coupled within a pocket formed in the upper rear region of the heel cup. The coupling permits the high back support to float about a pivot axis that is translatable a predetermined amount along transverse, longitudinal and vertical axes of the ankle support assembly so as to enable articulation of said ankle support device in a manner that closely approximates the articulation of the foot and ankle of the snowboard rider.

Holzer, in U.S. Pat. No. 7,011,334 issued 2006 Apr. 14, describes a snowboard base plate for supporting a boot having a support feature and supporting the boot at the rearward cuff region or back region. The support is pivotable about a pivot axis and is restricted by stops extending substantially parallel with the standing plane of the base plate and substantially transversely to the binding longitudinal axis.

Recognizing a need for better fixation of the front and rear portions of the boot, other systems introduced more rigid type mounting devices adapted to engage modified snow boots with mating components. One such snowboard binding holds a boot by cooperating front and heel brackets, as disclosed by Albrecht in U.S. Pat. No. 5,826,891 issued on 1998 Oct. 27. The heel bracket is coupled to a driving element that moves the heel bracket horizontally toward the front bracket and simultaneously downward. A spring piston locks the driving element to the closed position.

Yet another step-in binding for soft boots includes a ratchet bar as described by Eaton in U.S. Pat. No. 5,901,971 issued on 1999 May 11. The boot includes a downward projecting ratchet bar at the rear (heel portion) of the boot. A boot binding mounted to a snowboard includes a toe strap and a heel region member of a boot holder having a receptor for the ratchet bar.

Laterally Engaging Binding Systems for Soft Boots:

Devices that attach laterally to specially modified boot soles are also known in the art. This version of a step-in binding includes a first engagement member supported by a base and adapted to engage a first lateral side of a boot, and a second engagement member pivotally mounted to the base and adapted to engage a second lateral side of the boot as described by Dodge in U.S. Pat. No. 5,722,680 issued on 1998 Mar. 3. This lateral binding system is further described by Dodge in related U.S. Pat. No. 5,957,480 issued on 1999 Sep. 28 and U.S. Pat. No. 6,203,052 issued on 2001 Apr. 20.

Another lateral attaching mechanism for soft boots, described by Bejean et al. in U.S. Pat. No. 5,954,358 issued on 1999 Sep. 21, includes a first anchoring device for the sole of the shoe; a second anchoring device affixed to the sole; a base affixed to the board and on which are mounted an arrangement for rotationally guiding and vertically retaining the first anchoring device and a mechanism for latching the second anchoring device, the mechanism including a jaw member having a housing for receiving the second anchoring device, and a latch journaled on the jaw member. The latching mechanism includes an elastic return device biased during the displacement of one portion at least of the latching mechanism which is driven by the thrust exerted by the second anchoring device moving vertically, substantially along an arc whose radius is equivalent to the distance separating the two anchoring devices during the tilting of the shoe about the axis of rotation of the first anchoring device.

Yet another lateral mounting system is described by Gignoux et al. in U.S. Pat. No. 6,523,852 issued on 2001 Feb. 25. Gignoux describes a step-in snowboard binding that includes at least one jaw secured to a driving arm. The jaw has a cam-shaped part collaborating with a locking element that can move in a guide in such a way that the jaw is locked for various positions of the jaw. The jaw is equipped with a return spring to keep it in the open position, and the jaw and the locking element cooperate to keep the locking element away from its locking position when the jaw is raised. The binding is equipped with an indicator that indicates whether the jaw is in the locked position.

Binding Systems Combining Rigid Connectivity and Soft-Boot Comfort:

As mentioned by others in the art, it is desirable to have both the control characteristics of a rigid boot and the comfort and ease-of-use of a soft boot. Accordingly, there are attempts in the art to offer such a system. One example, taught by Rench et al in U.S. Pat. No. 5,906,058 issued on 1999 May 25, describes a boot and binding for step-in attachment to a snowboard that supports the rider's ankle and includes a sole having binding-receiving elements for attaching the boot to the binding on the snowboard. The sole also has toe and heel ends. The sole is formed with a heel counter at the heel end. Tread projects from the sole for traction when the boot is not attached to the snowboard. The strut extends upwardly from the heel counter of the base. The strut extends upwardly from the heel counter of the base. The strut provides aft support to the wearer. The upper is fixedly attached to the sole and is arranged and configured to receive the foot and ankle of the user. The upper has a rearward side adjacent the strut. The upper is more flexible than the strut and the highback. The binding disclosed includes a plate for attachment to the snowboard, a first coupling member to secure the forward end of the boot, and a second coupling member to secure the rearward end of the boot. The coupling members are releasably secured to the boot with at least one arm that extends from the side of the plate. The coupling member that secures the forward end of the boot may include either a set of jaws, a simple hook, or ridges on the sides of the toe portion.

One attempt to provide control characteristics of rigid boot and the comfort of a soft boot, described by Turner et al. in U.S. Pat. No. 5,505,477 issued on 1996 Apr. 9 (and further described in the associated continuing application issued as U.S. Pat. No. 5,690,350 issued on 1997 Nov. 25), teaches a system including a boot having a base, a highback, and an upper. The base includes a binding-receiving plate for attaching the boot to the binding on the snowboard. The base also has toe and heel ends. The base is formed with a toecap at the toe end and has a heel counter at the heel end. Tread projects from the bottom of the base for traction when the boot is not attached to the-snowboard. The highback extends upwardly from the heel counter of the base. The highback provides aft support to the user. The upper is fixedly attached to the base and is arranged and configured to receive the foot and ankle of the user. The upper has a rearward side adjacent the highback. The upper is more flexible than the base and the highback. A base strap is connected to opposing sides of the base and extends across a portion of the upper. The binding disclosed includes a frame for attachment to the snowboard, a first coupling member to secure the forward end of the boot, and a second coupling member to secure the rearward end of the boot. The coupling members are releasably secured to the boot with arms that extend from the sides of the frame. The coupling member that secures the forward end of the boot may include either a set of jaws or a simple hook. Both sets of coupling members hold the boot, within the sole of the boot, along an axis near the longitudinal center axis of the sole of the boot.

Another attempt to provide a stiffer boot includes removable vertical stiffening stays adapted to fit in corresponding vertical channels on a soft boot as described by Gillard et al. in U.S. Pat. No. 5,606,808 issued on 1997 Mar. 4.

Yet another attempt to provide a more rigid boot and stiffer mounting mechanism is described by Morrow et al. in U.S. Pat. No. 6,189,913 issued on 2001 Feb. 20. Morrow describes a step-in three-point binding that includes first and second binding pin-engagers on a first side of the binding and a third binding pin-engager on a second side of the binding. At least one of the binding pin-engagers moves from an unlocked to a locked position when the snowboarder steps onto the binding with a boot, securing the specialized boot to the binding.

Savard, in U.S. Pat. No. 6,076,287 issued on 2000 Jun. 20, describes a specialized soft boot with a rigid shank, which is well-suited for a freestyle snowboard boot and step-in bindings. Savard's stance support system is composed principally of a stance support shank; a bearing mount structured to be attachable to a snowboard boot heel counter, supporting a bearing having a bearing surface that is at least partially pivotal; and a shank retainer fitting structured to be attachable to the leg portion of the snowboard boot. One end of the shank is formed as a rocker for riding on the pivotal surface of the bearing, wherein it is rockable from an upright orientation through an instep-ward cant, and is rigidly restrained uprightly from rocking outward beyond the cant. The other end of the shank is a lever end engagable into the retainer fitting.

Yet another specialized boot and associated binding system for mounting a rider to a snowboard includes the device described by Maravetz et al. in U.S. Pat. No. 6,099,018 issued on 2000 Aug. 8. Therein Maravetz discloses a base having a toe end and a heel end, and a guide that is adapted to guide a snowboard boot back toward the heel end of the base when the snowboard boot is stepped into the binding. Another embodiment is directed to a snowboard binding including a baseplate and a heel hoop hinged for rotation relative to the baseplate. A further embodiment is directed a snowboard binding to mount a snowboard boot to a snowboard, the snowboard boot including at least one pin extending from medial and lateral sides thereof. The snowboard binding comprises a base having medial and lateral sides; a pair of engagement cams each mounted to one of the medial and lateral sides for rotation between open and closed positions; at least one lever to move the pair of engagement cams from the closed position to the open position; and a cocking mechanism that is adapted to maintain the pair of engagement cams in the open position upon release of the at least one lever.

Hale, in U.S. Pat. No. 6,283,492 issued on 2001 Sep. 4, teaches one or more energy transfer or resistance elements adapted to attach to a snowboard binding to provide gradually increasing resistance by means of a resistance element. The resistance element includes a housing containing a spring and an adjuster block. A bolt is passed through the spring and threaded into the adjuster block for setting a desired amount of tensioning. The angle of a highback is adjusted by a lean adjuster, which is also threaded into the adjuster block. According to other embodiments, the resistance element can be a strap having an expandable portion, a strap combined with the spring, or a torsion spring.

Utilizing the plate-style binding, but pairing it with a more comfortable soft boot, Hirayama et al. in U.S. Pat. No. 6,467,795 issued on 2002 Oct. 22 discloses a snowboard binding having a highback that provides a tight fit between a soft boot and the highback. The snowboard binding has a base plate, a first binding member and a second binding member. The first binding member is coupled to one of the front and rear portions of the base plate. The second binding member is coupled to the other of the front and rear portions of the base plate. The second binding member is coupled to the base plate at a location that is longitudinally spaced from the first binding member. The second binding member includes a catch member movably relative to the base plate and a latch member movable movably relative to the base plate. The latch member is arranged to selectively hold the catch member in a plurality of engagement positions having different heights above the base plate.

Okajima et al., in U.S. Pat. No. 6,530,590 issued on 2003 Apr. 11 and U.S. Pat. No. 6,595,542 issued on 2003 Jul. 22 and U.S. Pat. No. 6,648,364 issued on 2003 Nov. 18 and U.S. Pat. No. 6,857,206 issued 2005 Feb. 22, teaches a snowboard binding system including a boot having a mid sole constructed of a first material and an outer sole constructed of a second material. The first material has a lower coefficient of friction than the second material. First and second rear catches are formed on first and second lateral sides of the mid sole to engage a rear binding arrangement of the binding. A front catch of the boot selectively engages a front binding member of the binding. The outer sole partially covers the mid sole such that the mid sole is exposed in an area adjacent at least one of the first and second lateral sides. The binding includes a base member with a rear guide member and has an upper boot support surface arranged to contact the exposed area of the mid sole.

Jones et al., in U.S. Pat. No. 6,557,866 issued on 2003 May 6, teach a snowboard binding including a top plate for affixation to a sole of a boot and a bottom plate for affixation to a snowboard. The top plate has two spaced apart and opposed upturned and inwardly angled end walls, and a locking bar with a hole formed therein. The bottom plate has two opposing end tabs which are inwardly angled by a predetermined angle generally mating to that of the end walls of the top plate. The bottom plate has a locking mechanism with a locking pin adapted to be biased into a hole formed in the locking bar when the top plate is fully engaged with the bottom plate.

Otsuji et al. disclose a snowboard interface with articulating upper and lower portions in U.S. Pat. No. 6,663,118 issued on 2003 Dec. 16. The snowboard interface has an upper interface and a lower interface, wherein the upper interface rotates and translates relative to the lower interface. More specifically, the snowboard interface includes a foot interface, a leg interface and a coupling mechanism for coupling the leg interface to the foot interface so that the leg interface translates sideways and rotates sideways relative to the foot interface.

Split Board Designs:

The prior art includes new approaches to the traditional snowboard design in an ever-increasing attempt to improve rider enjoyment. One such new approach is a split board design. One example of a split board design includes the touring snowboard of Wariakois, described in U.S. Pat. No. 5,984,324 issued on 1999 Nov. 16 wherein a snowboard is comprised of two separable ski members, each having at least one non-linear longitudinal edge, and being adapted for conjoining together to selectively form the snowboard. The snowboard further comprises ski bindings associated with each ski member and a snowboard binding assembly, which is comprised of elements associated with each ski member. Thus, boot bindings can be readily positioned between a skiing mode and a snowboarding mode. The ski bindings are adapted for both fixed-heel and free-heel binding to accommodate conventional alpine and telemarking skiing.

Another split board design, described by Maravetz in U.S. Pat. No. 6,523,851 issued on 2003 Feb. 25, includes a binding mechanism used to securely couple board sections of a touring snowboard together. The binding mechanism includes a first interface mounted to at least one of first and second board sections and a second interface mounted to the base. A clamp is mounted to the first or second interface and is movable between a closed configuration, wherein the interfaces are adapted to engage with each other, and an open configuration wherein the interfaces are adapted to release each other. When in the open configuration, an amount of clearance exists between the interfaces. When the clamp is moved to the closed configuration, the amount of clearance is decreased to securely join the board sections together. The clamp exerts a clamping force in at least two non-parallel directions to draw the board sections together. The clamp further mounts a snowboard boot binding to the board sections when in a snowboard mode, or to one of the board sections when in ascension mode.

Yet another specialized boot is described by Fletcher in Pub. No. US 2010/0154254 published on 2010 Jun. 24. Therein, a boot includes a binding mechanism for attachment to a snowboard.

Other Improvements to Boot and Board Designs Including Binding Systems to Enhance Comfort and/or Performance:

Musho et al. in Pub. No. US 2002/0089150 published 2002 Jul. 11 disclose a snowboard boot that includes an upper and a binding interface adapted to engage with a snowboard binding. The interface is supported from the boot upper so that even when the interface is rigidly engaged by the binding, the boot upper can advantageously roll or flex side-to-side relative to the interface, and consequently the snowboard, to provide a rider with a desirable feel of foot roll. The boot may be configured so that a segment of the boot upper rearward of its toe portion can flex in the side-to-side direction relative to the binding interface, while the forward toe portion of the boot upper remains fixed against side-to-side flexibility. A flexible connection may be employed to couple the binding interface to the snowboard boot upper to allow the segment of the lower portion thereof to flex relative to the binding interface. The flexible connection may extend along a substantial length of at least one of the heel portion, the in-step portion and the toe portion of the upper. The flexible connection may be constructed within at least one of the lateral and medial sidewalls of the snowboard boot upper. The flexible connection may include a flexible panel to mount the interface to the boot upper. The panel may include a fabric or other flexible material, including stretchable and non-stretchable materials.

Neiley, in Pub. No. 2007/0169377 published on 2007 Jul. 26, describes a boot having an upper formed of articulating panels that permit portions of the boot to move in substantial independence from one another in response to loads experienced by the boot.

Kaufman, in Pub. No. US 2009/0223084 published on 2009 Sep. 10, describes a hands-free fastening mechanism for releasably securing a user's foot to a binding.

Yet, despite the myriad of binding and boot systems known in the art, there remains a need for an improved binding and boot system that provides substantial feel and flexibility for the rider and yet, at the same time, provide sufficient rigidity so the board's response to rider input is enhance. There is a need for a boot and binding system than can transfer movement of the rider's foot and lower leg to a more immediate and direct control of the board and, at the same time, provide sufficient comfort to enable the stunt-rider to better perform board tricks. Further, there is a need for a boot and binding system that is comfortable to wear, reduces fatigue from use, provides support to the lower leg and foot, and has safety mechanisms to minimize injury from prolonged use and to provide improved protection from accidents.

There is further a need for a boot and binding system that can adapt to the ever-growing area of split-board snowboarding and related snow activities. Because a split-board has a different binding set-up—two sets of bindings, in fact: one for skinning up the mountain and a second for riding back down that must be able to be "split" while skinning up the mountain.

There is a further need for a boot and binding system to integrate with certain existing boot and binding systems to reduce the cost to the rider who may already own expensive equipment and prefer to integrate a new system with his or her existing components.

In one contemplated embodiment, the binding system of the present invention fits existing hole-patterns, such as the Voile hole pattern. Thus, a rider could utilize the present invention including the bindings and boots on their existing split-boards—not as a supplemental system but rather to entirely replace them.

There is further a need for a boot and binding system that enables a snowboard rider to have a choice in the selection of outer and inner materials, and to select more or less rugged, or lighter or heaver components based on the rider's skill, interest, intended terrain and budget.

SUMMARY OF THE INVENTION

The present invention overcomes limitations of the prior art and provides a boot and binding system for snowboards with unique features that provide enhanced performance and control found only in rigid-boot step-in systems with the feel, comfort, and flexibility associated with soft boots without any of the drawbacks of strap-in systems.

Accordingly, the present invention comprises a series of articulated hard-shell components making the upper portion of the boot and covering the top of the foot including the toe and heel. The hard-shell like components encase a soft inner layer including a soft, rubber-like sole. The articulated shell-components act like a soft-boot in one direction and like a rigid boot in the opposite direction, thus the boot of the present invention offers key characteristics of both types of prior-art boot without the drawbacks. Because the boot acts, in some capacities, like a rigid boot, the binding system in the present invention forgoes the heel support structure taught by the prior art soft-boot designs. And, the binding system couples to the hard-shell components of the boot, the soft sole is in direct contact with the board surface, allow the flex and feel needed and desired by recreation and trick-riders.

Advantages of the various contemplated embodiments of the present invention include coupling components above double as means to secure rider's foot in boot (i.e. no need for laces, bolo wires, or additional buckles), a Vibram-type rubber or synthetic sole, boot-edges shank for crampons, inherent features that are designed to couple with standard automatic crampons; adaptable to toe/heel peg specific items (crampons, snowshoes, etc); Boot cuffs with tails serves boot and binding functions; Heel step lever is step in mechanism, but also provides lateral support and secures boot to binding; Toe pegs provide pivot point for stepping in, in conjunction with toe cup, serves purpose of conventional binding toe strap; Boot and heel pegs secured into binding provide superior edge-to-edge performance and feel over conventional strap system (immediate response due to superior leverage of pegs over straps); and Boot instep "strap" with multiple buckles but with a single lateral and single medial grommet serves multiple purposes: secure rider's foot in boot; couple boot to the binding; provide rider support (lateral, medial, all around), for example.

Additional advantages to the present invention include a design that virtually eliminates "heel lift." Heel lift is when the rider's heel loses contact with the inside sole of the boot when the rider makes a toe-side turn. Heel lift reduces control, feel, and safety. It also reduces boot life. Heel lift occurs because a rider uses the front of the boot (laces, tongue) for leverage on the toe-side turn. Thus, the foot moves within the boot. Heel lift becomes worse and worse over time as the boot is repeatedly stressed by toe-side turns.

The boot of the present invention primarily relies on the spine and/or stacked articulated cuffs to transfer energy and restrict forward lean, not on the tongue and laces, as taught in the prior-art. Think of it as "pulling" rather than "pushing" forward to make the turn. Because the force on the forward portion of the boot is minimized by the spine and articulated cuff design, the root cause of heel lift is removed. No other prior-art boot addresses heel lift in this fashion.

This is a new gliding board boot and binding that is a true step-in binding/boot system with strap boot/binding performance or better. In broad strokes, this is accomplished using toe boot pegs that pivot against binding hooks when stepping down into the binding toward the heel to engage an instep coupler integrated into the boot. The stepping action engages the instep coupler, and at the point when the boot is flush (or the boot sole is slightly compressed against) the binding base plate, the instep coupler is fully engaged, thus creating tension across the instep of the foot similar to a conventional strap, but with better performance characteristics.

The present invention also contemplates several methods related to snowboard boots and bindings. One contemplated method is coupling a snowboard boot to a step-in snowboard binding with a toe end connection and an instep connection that creates tension across the rider's foot when coupled. This can be understood in a number of ways. The key elements are: step-in convenience+tension across the instep of the rider's foot+connection to the board. The work of stepping into the binding creates elastic potential energy in the boot/binding coupler across the rider's instep. Although current step-in bindings use springs (which have elastic potential energy) in their locking and release mechanisms, no current step-in binding uses elastic potential energy in mating a step-in boot to binding to provide strap like performance. A conventional instep strap, when synched down, has elastic potential energy across the rider's instep; this system creates that same elastic potential energy across the rider's instep in a step-in system.

Another contemplated method includes forming portions of a snowboard boot from carbon fiber material. Using carbon fiber in the leg portion of a snowboard boot is advantageous because of the ability to control the flex patterns of carbon fiber elements through the manufacturing process. For example, in the disclosed preferred embodiment, the boot cuffs are preferably formed of carbon fiber.

Additional new features support the above new step-in binding-boot system. For example, the boot employs a new configuration to provide desirable flex and support without the aid of an external high-back or conventional-boot-supported-by-binding configuration. Instead, the boot uses stacked, articulated cuffs connected via a flexible material such as woven nylon with a removable spine that travels down the rearward of the boot. In addition to the cuff material and connections to other cuffs and the rest of the boot, desired flex (greater stiffness rearward and lesser frontward), the cuffs tapper from broader to narrower as they wrap from rearward to frontward. The shin ends of cuffs are connected using ratcheting straps. Preferably, these are the "2 button" type for the release mechanism to assist avoiding accidental release.

In another contemplated embodiment, the boot as previously disclosed, includes a plurality of interchangeable cuff members. A first cuff member selectively couples to the heel portion of the boot. A second cuff couples to the first cuff, and a third cuff couples to the second cuff. Accordingly, a boot can include a leg-portion consisting of one, two, three or more cuff segments to provide further customization of the boot for comfort and performance according to the individual rider's preferences.

Additionally, in snowboarding, the greatest support is required along the rear of the boot (provided by a high-back in conventional bindings). In addition to the configurations noted above, to aid in providing this added support, the rearward portion of the cuffs has a member that protrudes downward, overlapping the cuff below. When the boot flexes rearward, these "tails" provide a limit to rearward flex. The angle that results is known as the "forward lean." Forward lean is adjusted by a mechanism on the heel cup that moves a wedge upward between the lower cuff tail and the heel cup. For even "finer" adjustment, a similar mechanism may be placed on the lower cuff to control the most-reward movement of the middle cuff, and so on upward to the top cuff.

In one contemplated embodiment, a binding system for a snowboard comprises: at least one binding baseplate coupled to the snowboard, the baseplate further comprising a frame portion and a disc portion, whereby the disc portion couples to the snowboard and enables selective rotatable coupling to the frame portion whereby a rider can selectively adjust a longitudinal axis of the base plate relative to a longitudinal axis of the snowboard; the frame portion further comprising a first toe hook disposed adjacent to a front portion of the frame and a second toe hook also disposed adjacent to the front portion wherein the first toe hook arranges to a distal side of the frame and the second toe hook arranges to a proximal side of the frame; the frame further comprising a release mechanism disposed adjacent to a rear portion of the frame; and at least one boot adapted to selectively engage the binding baseplate, and wherein the boot further comprises a soft sole portion, a rigid shell comprising a plurality of mechanically interconnect portions, the plurality of portions comprising at least one leg portion, a toe portion and a heel portion, the heel portion coupled to the sole portion, the toe portion having first and second toe peg arranged adjacent to a toe-end of the sole, each respective peg cooperating with the first and second toe hook presented by the baseplate to operate from a releasing-position to a locked-in position, and the rigid heel portion further comprising oppositely disposed heel pegs adapted to selectively engage the release mechanism.

This contemplated system further includes: the boot having a soft sole with no mechanical links to the binding; the boot having an instep portion having at least one internal strap member connected at each end to a corresponding medial or lateral grommet by means for tightening each end of the strap; the respective medial and lateral grommet being adapted to selectively engage instep grommet binding hooks presented by the release mechanism of the binding wherein a rider placing weight on the release mechanism places the strap member in tension; the boot further having a hard-shell heel portion with a lateral and medial heel peg, the heel portion selectively engaging the frame of the binding causing the release mechanism to operate to a locked position causing the grommet binding hoods to travel inward and grapple the grommet; the boot further having at least two interlocking cuffs, each cuff having a tail portion and a slot for selectively receiving a spine member.

In one preferred embodiment, the boot works in concert with the binding to address both the performance and step-in requirements. Key boot features that enhance performance include:

Stacked, articulated boot cuffs—this innovation combines the function of boot upper and the binding high back (although a hybrid "HB" embodiment is also contemplated). The cuffs may be tapered from rearward to frontward to aid the desired flex pattern of greater stiffness rearward at 6 o'clock to progressively lesser stiffness frontward at 12 o'clock.

A spine travels down the rearward of the boot. This innovation provides additional support and customization that provides another element to control boot flex.

Instep Cables—multiple cables (straps) 235A, 235B, 235C (commonly 235) lie across the instep of the boot (and are an integral part of the boot) serving the function of the conventional instep strap. The length of these cables is micro adjustable. Once a rider sets the length to achieve the desired tension while boot is engaged with step-in binding (the equivalent to setting a conventional strap binding by ratcheting down the instep strap until snug), no additional adjustments are required because disengaging the boot from the binding releases the tension in the instep cables; similarly, stepping back into the binding reengages them. Thus, resetting binding straps between every run becomes a thing of the past.

Customization—the cuffs and spine are removable and interchangeable. Thus, in addition to providing a rider the ability to fine tune the flex of the boot in ways no prior art provides (for example, stiffer spines and cuffs for freeriding and softer spines and cuffs for freestyle), such interchangeable parts provide the potential for an after-market revenue stream. And, Soft boot sole—this system does not use a "hard" step-in binding mechanism on/in the sole of the boot like prior step-in boots. Consequently, the boot sole remains soft, providing the preferred feel and increased feedback desired by riders and never before available in a step-in boot.

DRAWING

FIG. 2 is an offset left side view of a portion of a binding system according to a preferred embodiment of the present invention.

FIG. 4*a* is a front view of the spine of FIG. 4.

Figure 4B:
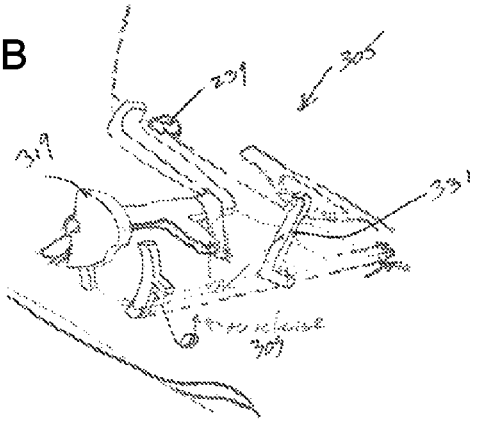
FIG. 4 is a rear view of a boot according to a preferred invention and shows a spine component inserted in a feature of interconnected cuff elements.
Figure 5:
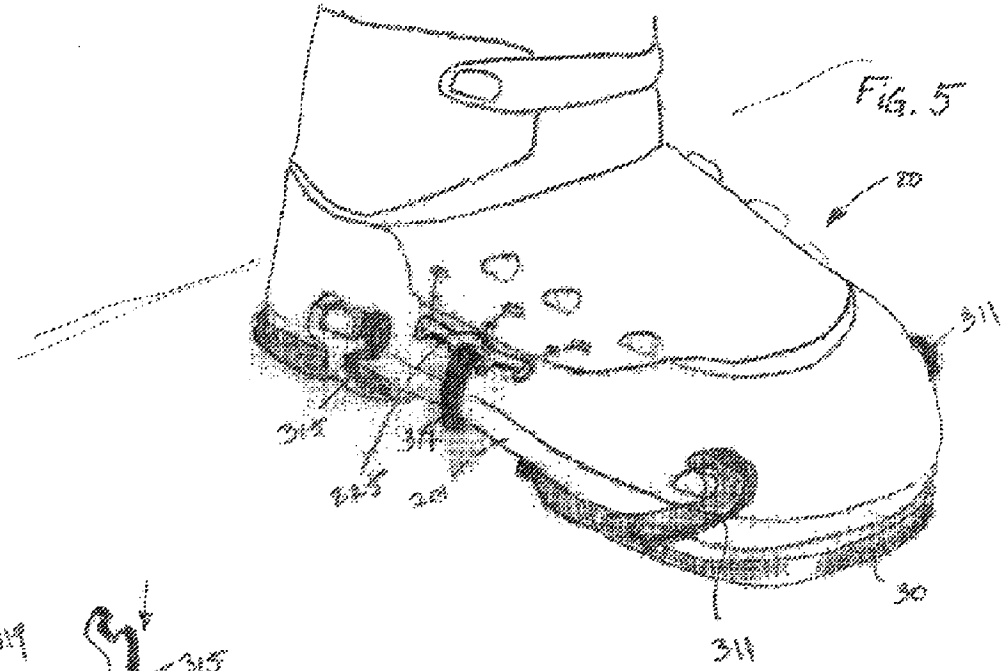

FIG. 4*b* is a detail view of the binding of FIG. 5.

FIG. 5 is a partial offset left side view of a boot and binding system of a preferred embodiment of the present invention.

Figure 6:
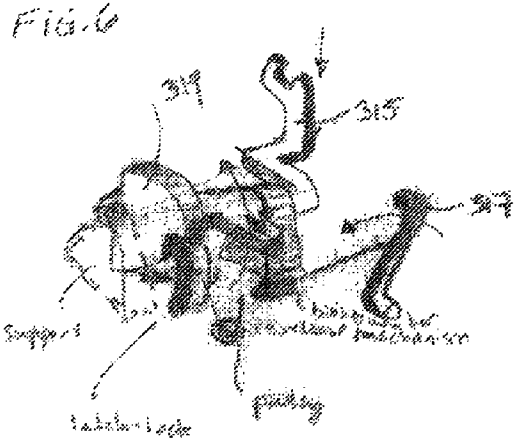

FIG. 6 is a partial component view of a binding system according to a preferred embodiment of the present invention.

Figure 7:
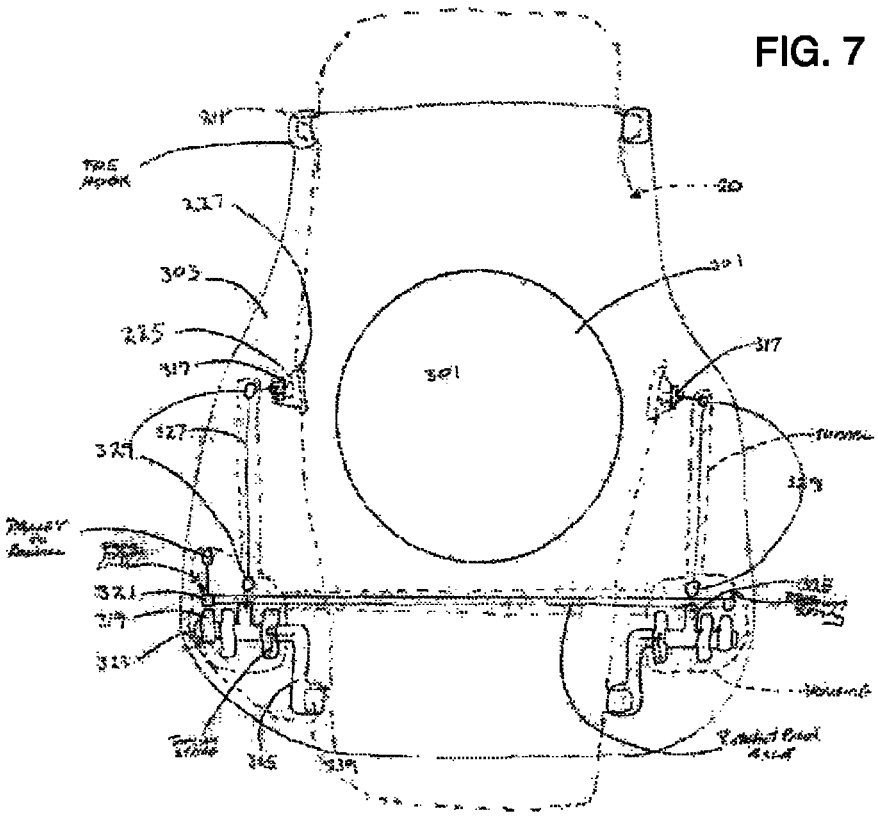

FIG. 7 is a top view of a preferred embodiment of the present invention illustrating a binding release and locking mechanism.

Figure 8:
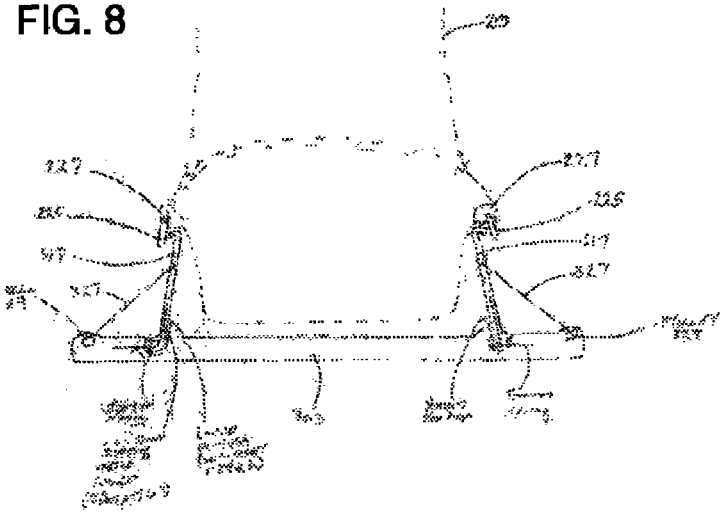

FIG. 8 is an end view of a binding according to a preferred embodiment of the present invention illustrating operation of the binding locking and release mechanism.

Figure 9:
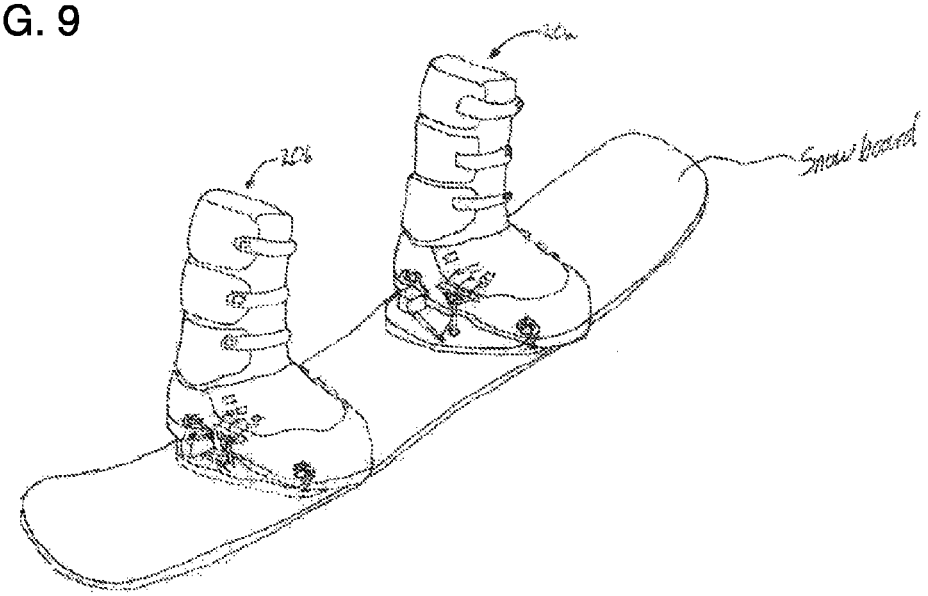

FIG. 9 shows a snowboard having a pair of boot and a binding system according to a preferred embodiment of the present invention.

Figure 10:
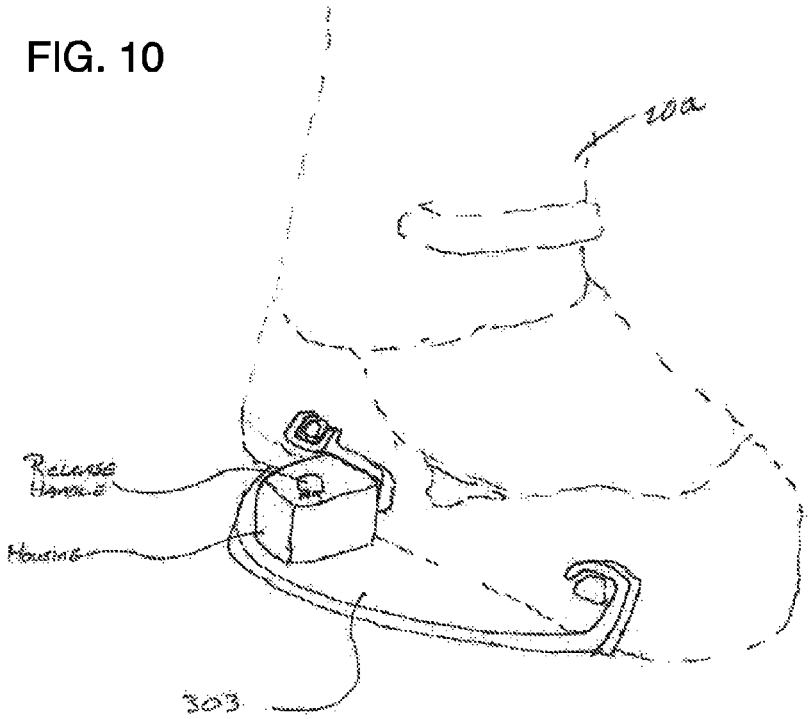

FIG. 10 is an offset side view of a binding system in relation to a boot according to a preferred embodiment of the present invention.

Figure 11:
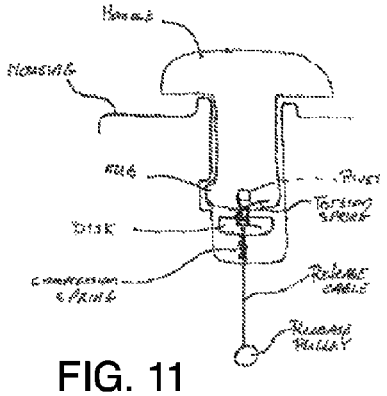

FIG. 11 is a detail view of a release mechanism for a binding system according to a preferred embodiment of the present invention.

Figure 12:
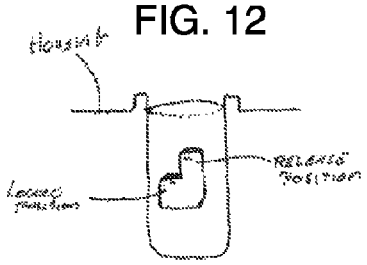

FIG. 12 is a partial detail view of the release mechanism of FIG. 11.

Figure 13:
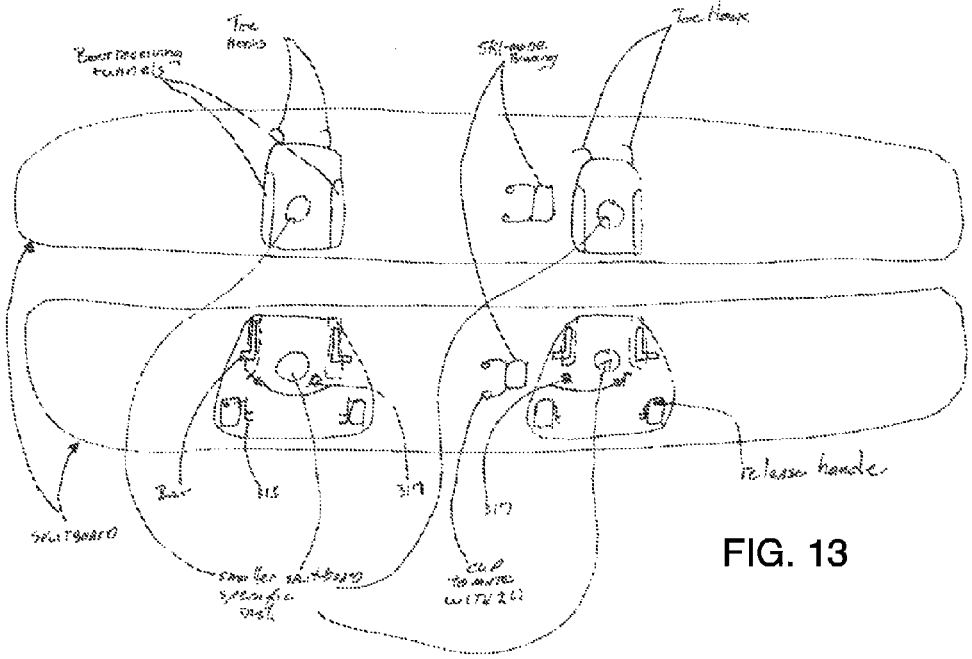

FIG. 13 is a top view of a split ski system including a binding system and pair of boots according to a second preferred embodiment of the present invention.

Figure 14:
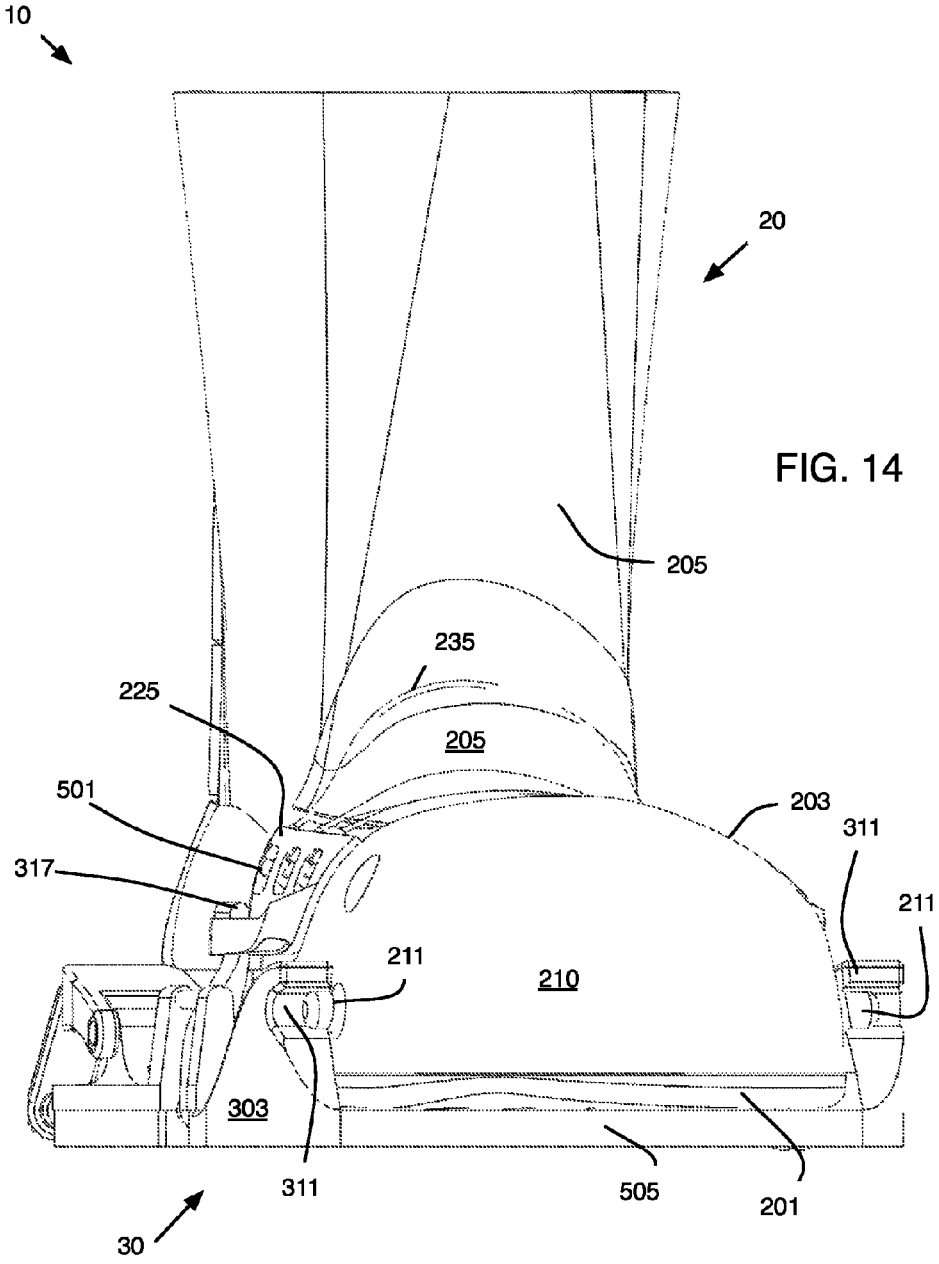

FIG. 14 is a front view of another preferred embodiment of the present invention.

Figure 15:
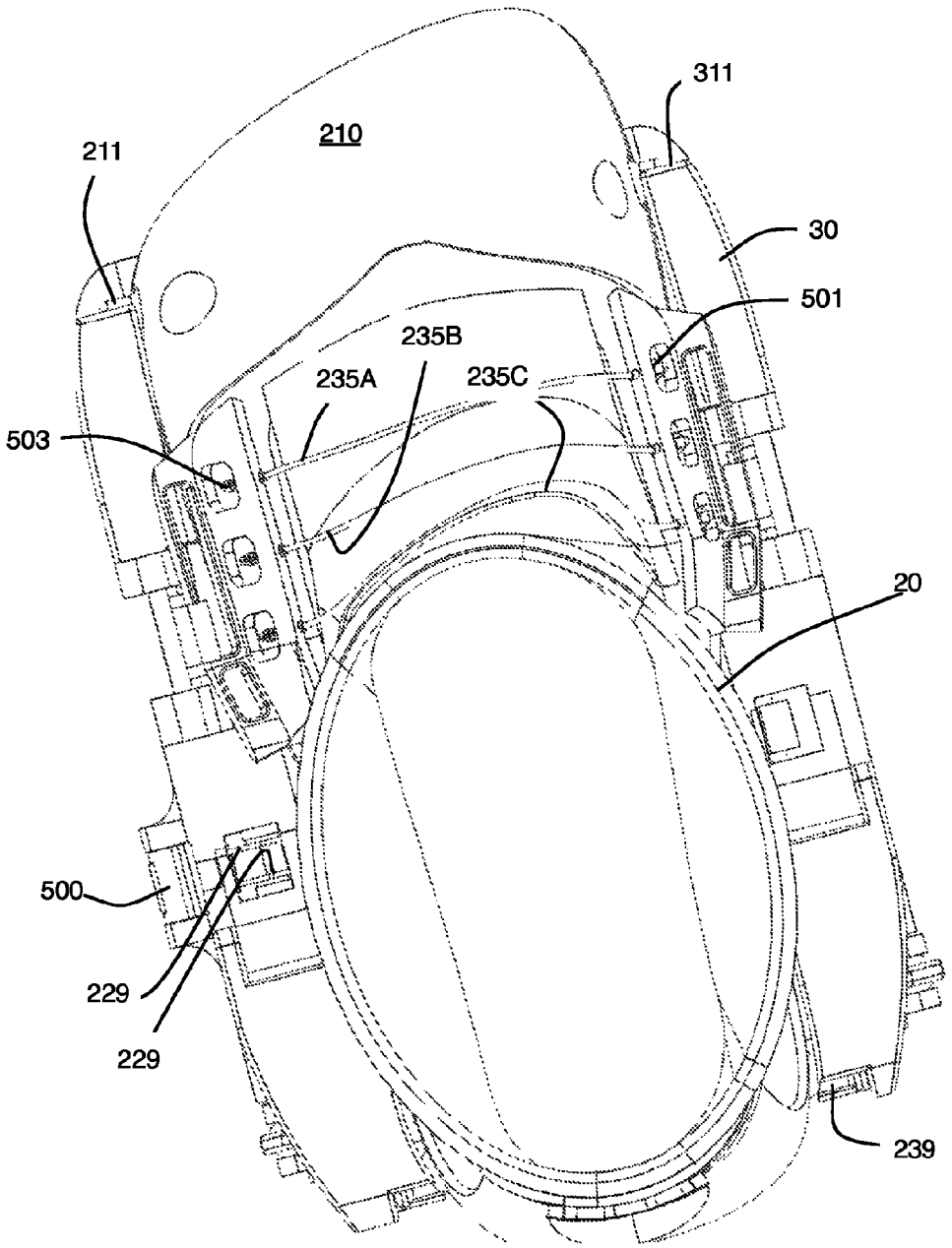

FIG. 15 is a top view of the embodiment of FIG. 14.

Figure 16:
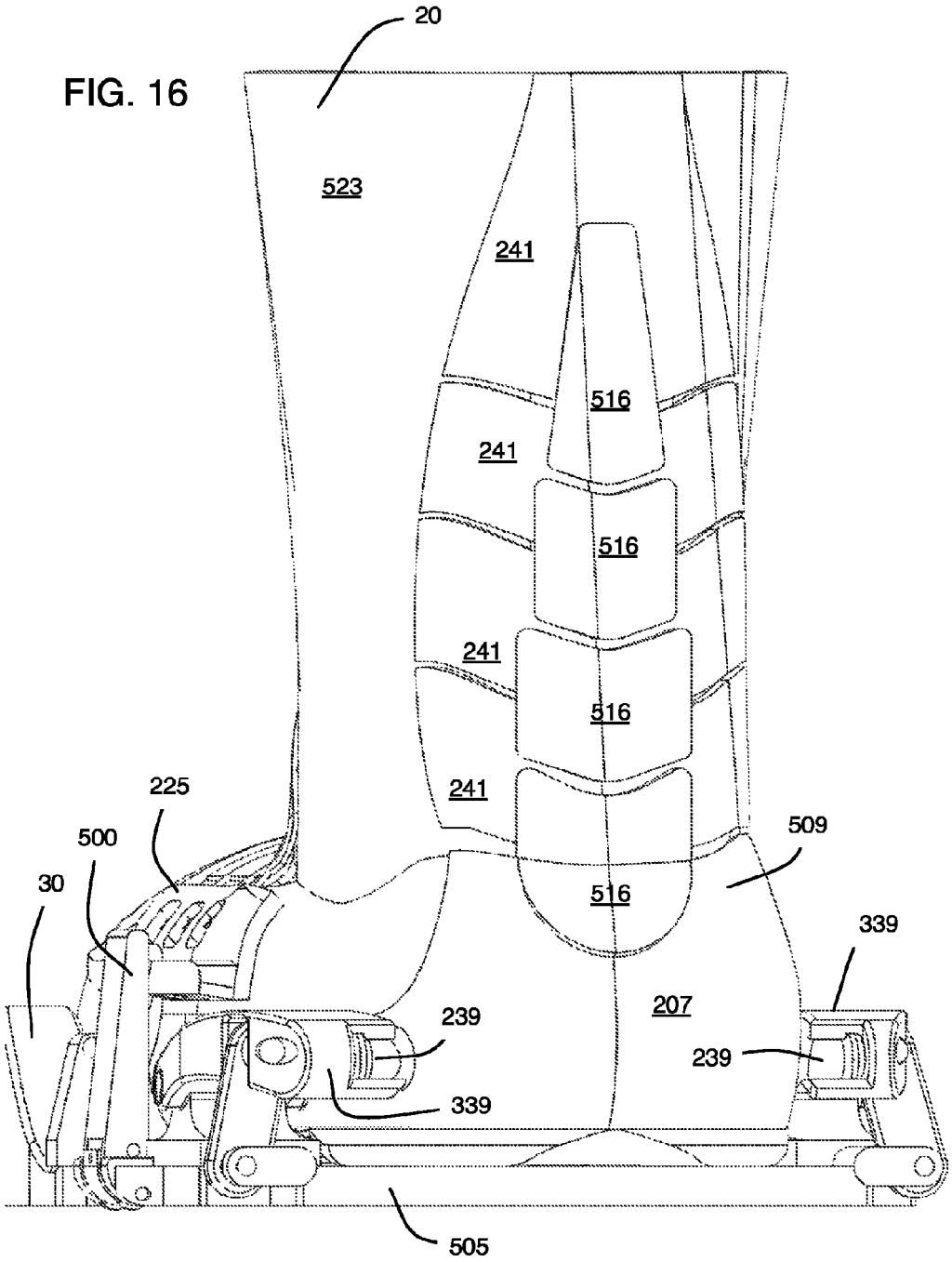

FIG. 16 is a rear view of the embodiment of FIG. 14.

Figure 17:
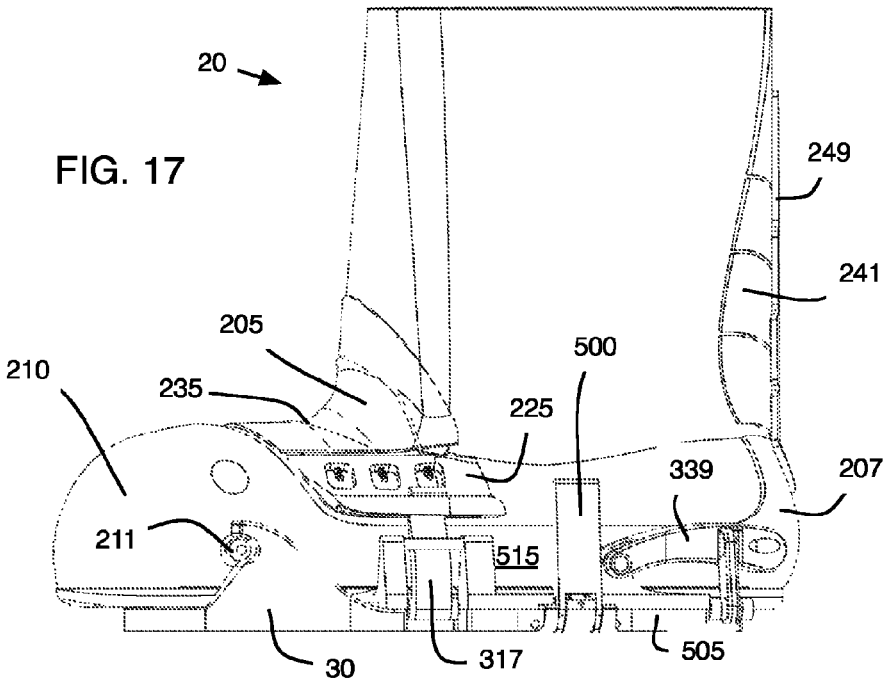

FIG. 17 is a left-side view of the embodiment of FIG. 14.

Figure 18:
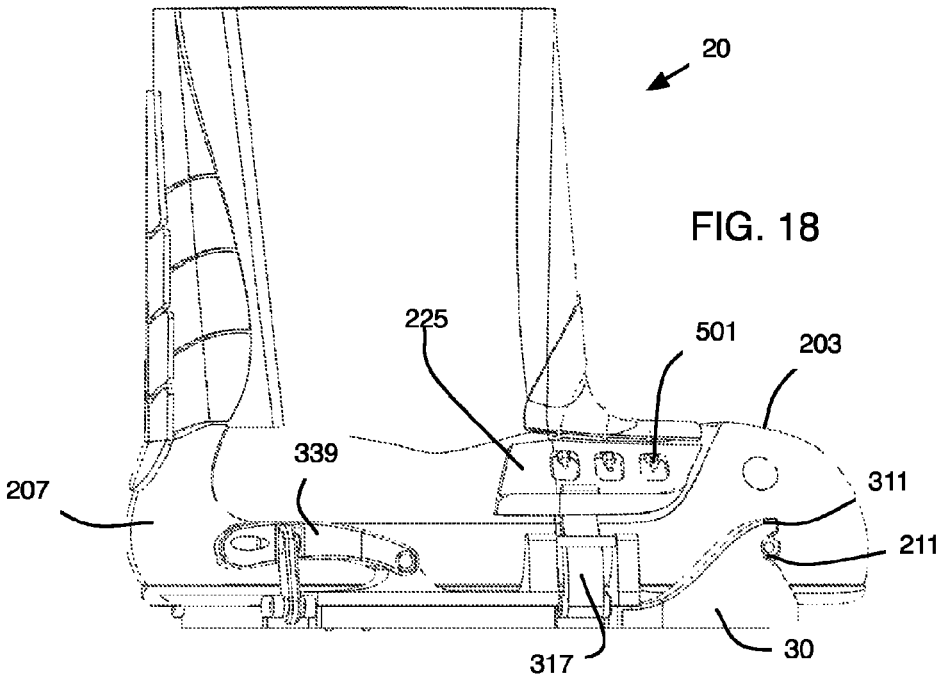

FIG. 18 is a right-side view of the embodiment of FIG. 14.

Figure 19:
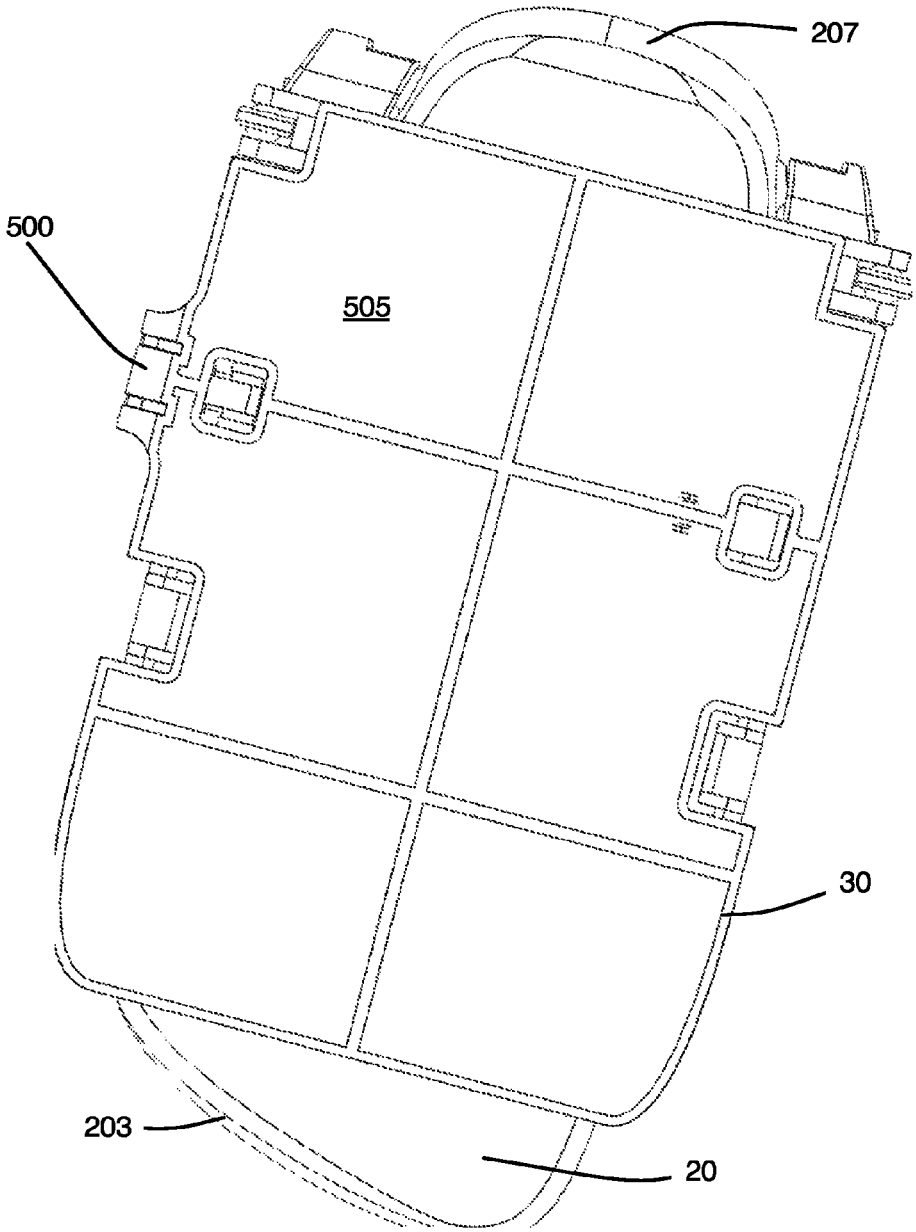

FIG. 19 is a bottom view of the embodiment of FIG. 14.

Figure 20:
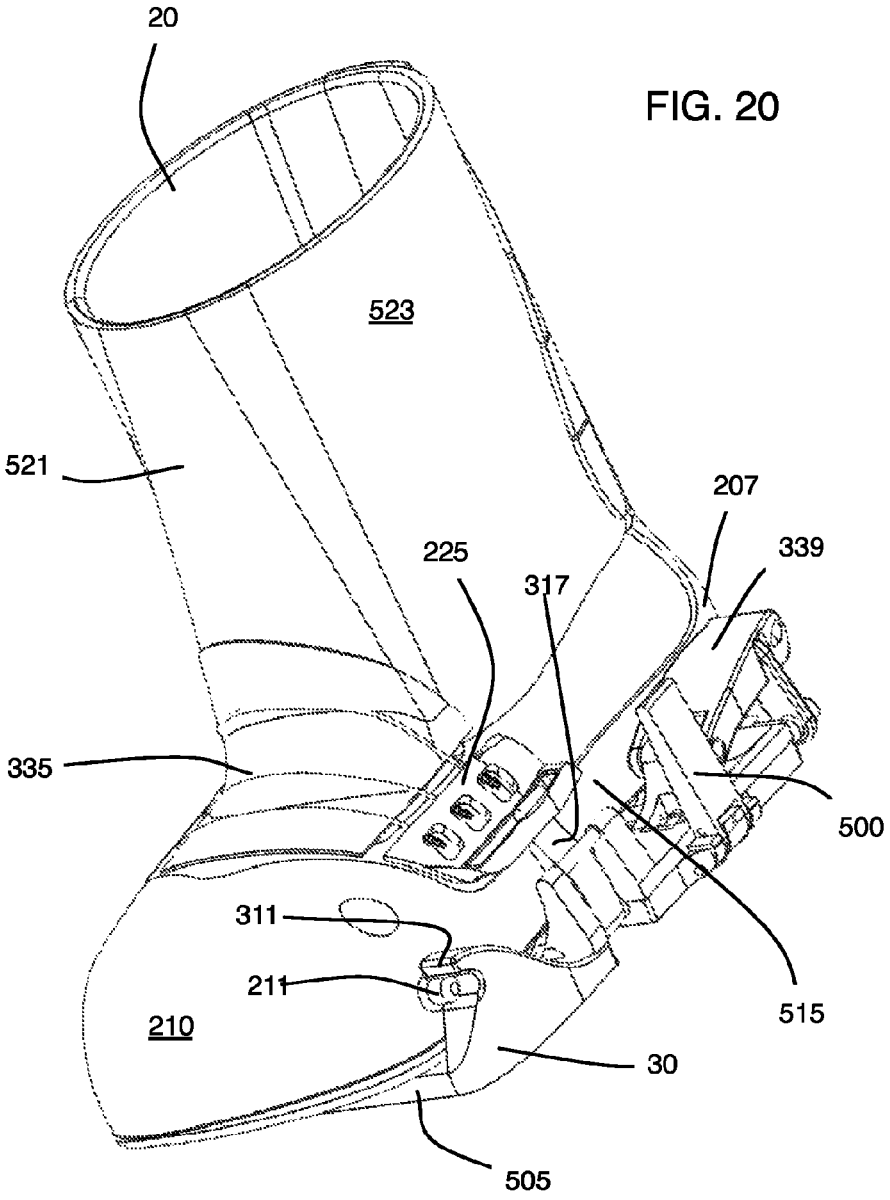

FIG. 20 is an offset front view of the embodiment of FIG. 14.

Figure 21:
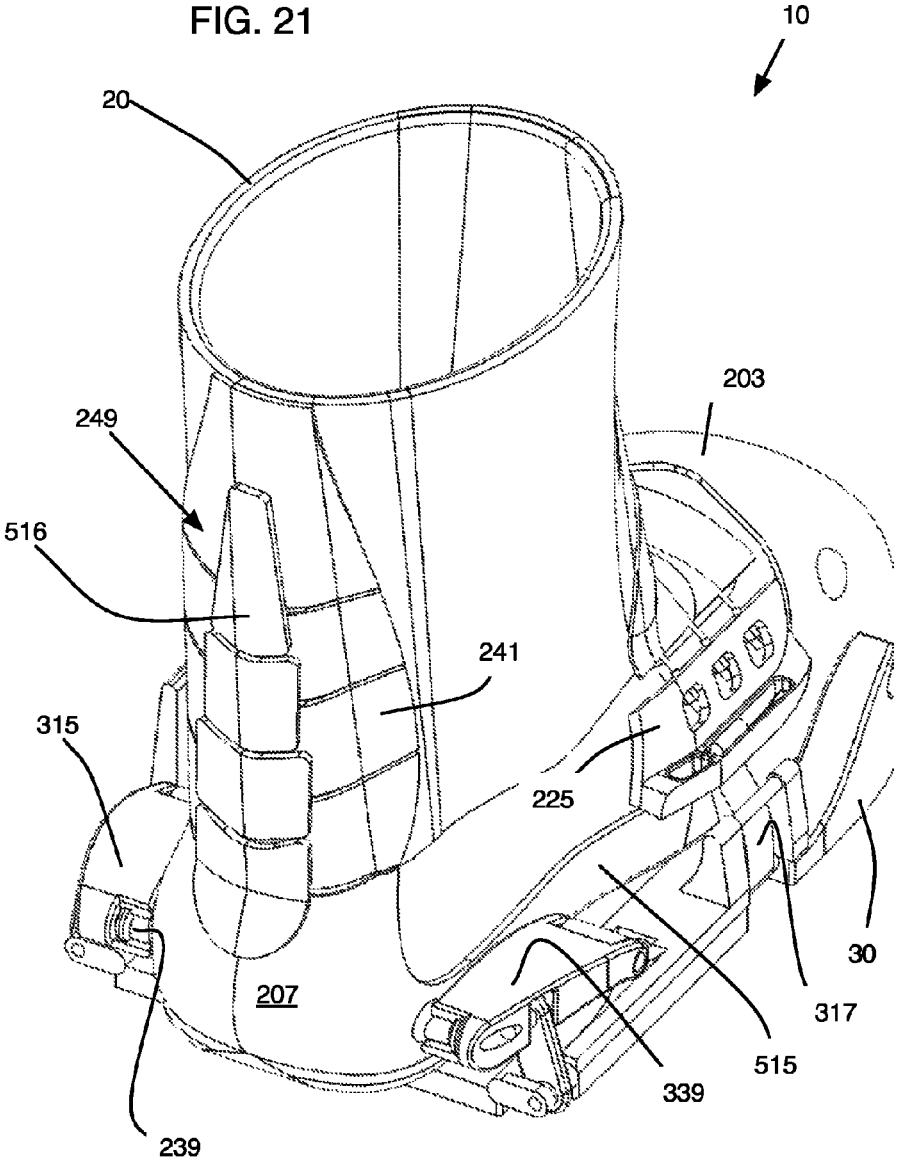

FIG. 21 is an offset rear view of the embodiment of FIG. 14.

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
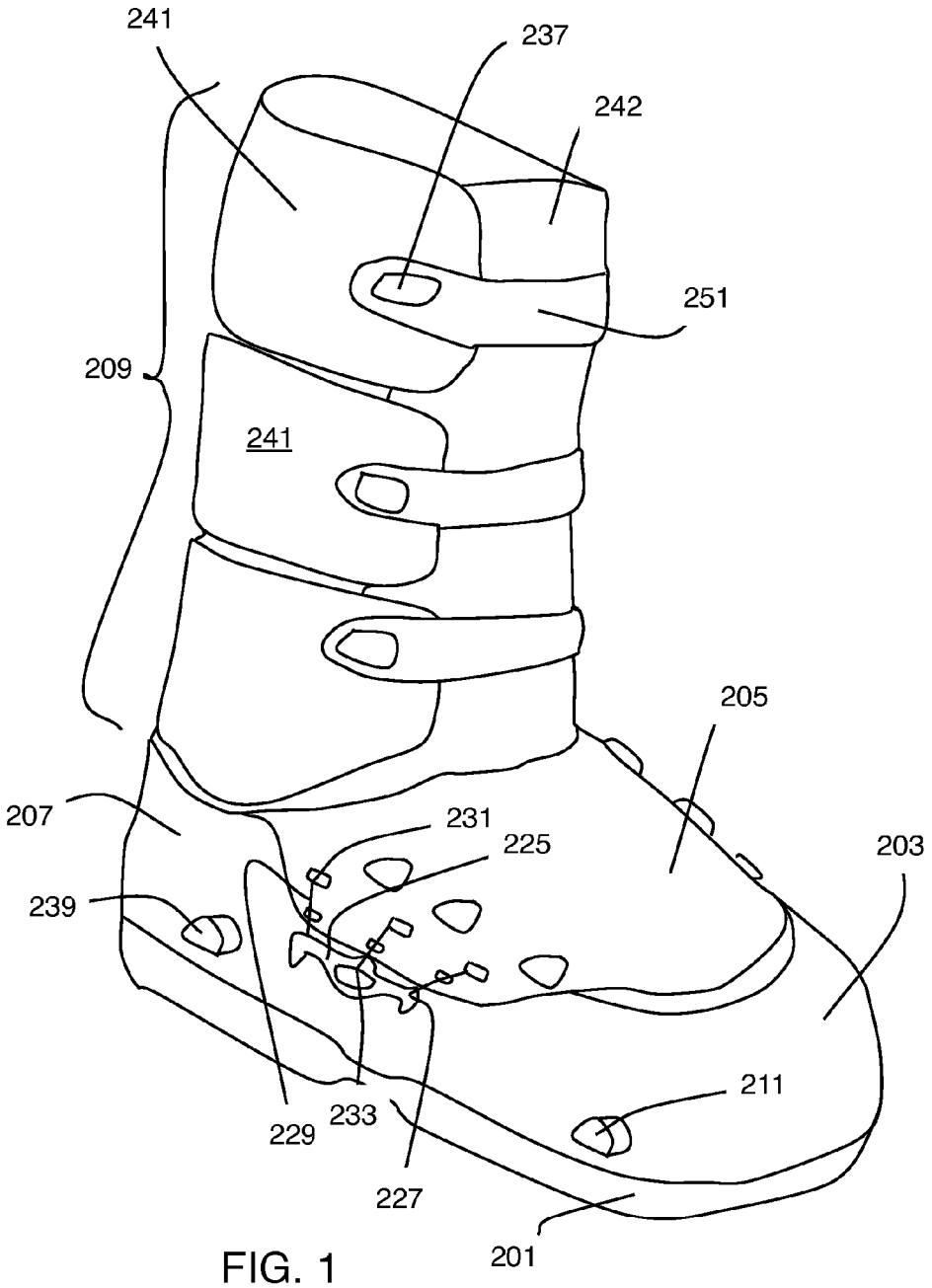
FIG. 1 is an offset left side view of a boot according to a preferred embodiment of the present invention.

In one preferred embodiment a Snowboard combination Boot and Binding system 10 includes a boot 20 and binding 30. FIG. 1 illustrates a boot 20 according to a preferred embodiment of the present invention. The boot comprises a sole 201, a toe portion 203, an instep portion 205, a heel portion 207, and a leg portion 209.

The sole 201 provides support for walking, assist lateral support, feel for riding, and traction, especially on snow and ice. To achieve these purposes, the sole edges should be a harder material to provide lateral support while the sole center portions, especially of the forefoot, should be of softer material to provide superior feel while riding. An advantage of this step-in boot over current step-in boots is that, because this boot does not use an binding member on the bottom or side edges of the sole, the sole may be soft to provide superior feel, whereas current stiff soled step-in boots have a "dead" feeling due to the metal parts in the sole and general stiffness in the sole that is required to cam the boot between forward and aft binding mechanisms.

A "hard core" version of the sole for "ski mountaineering" is also contemplated. In this embodiment, the sole is of a stiffer material and uses a more aggressive traction, such as a "vibram" sole. In addition, rather than being as soft as reliably and safely possible as the recreational version that prioritizes supple feel on the bottom of the foot, this variation is sufficiently stiff to accommodate fully automatic step-in crampons (such crampons are incompatible with soft soled boots). Thus, similar to crampon compatible hiking boots, this variation may include a stiffer conventional boot "shank" to achieve the greater stiffness desired for ski mountaineering. In addition, a snowboard specific shank is contemplated as well: one that follows the medial and lateral edges of the sole rather than down the midline of the boot like conventional boot shanks. This medial and lateral boot edge shank allows as much softness over as much of the bottom of the sole as possible to be preserved, thus providing superior ride feel while allowing step-in crampon compatibility and performance.

The toe portion 203 protects the forward portion of the foot, provides connection points to the binding, and leverage for steering the board. To achieve these purposes, in the preferred embodiment, the toe portion has a toe cup 210 of a semi-stiff material, such as plastic, and toe pegs. The left and right toe pegs 211, which extend outside of the boot, are adapted to engage the binding system as described herein. To add mechanical strength and to assure proper alignment with the binding system, the toe pegs 211 include, optionally, a linking member adapted to follow the contour of the toe cup and extend over the toe portion of the boot wearer, and further optionally the toe pegs may be made from metal such as aluminum or stainless steel. This linking member may be embedded, molded, or otherwise inserted in the cup portion so as to be transparent to the wearer of the boot. The toe pegs are a material that can handle the stresses and temperatures encountered for its intended use. Alternatively, the boot may include a rigid outer material that serves as an exterior skeleton, and therefore not requiring a mechanical linking member internally: In this case, the outer material is durable and rigid enough to withstand the binding forces and is well understood by those skilled in the art.

The toe cup 210 is fixedly attached to the sole 201 and instep portions 205. In the preferred embodiment there are two toe pegs 211—one laterally and one medially (left and right). The toe pegs are configured to mate with the toe hooks 311 (for example, as FIG. 2 shows) on the binding to assist temporarily attaching the boot to the board for riding.

The pair of left and right toe pegs 211 are configured to allow the boot to be coupled items other than a conventional snowboard. For example, to couple with a split-board binding in ski mode, the pegs should be cylindrical to permit pivoting action while "skinning" (traveling over terrain with skins on the skis) similar to telemark and randonee ski touring systems. The toe cup 210 may be configured to mate with conventional crampons, including semi-automatic or step-in crampons. Configuring boots to mate with crampons, including ski boots and hard snowboard-boots, is well known in the industry.

The instep portion 205 protects the rider's foot, provides connection points to the step-in binding, and, in conjunction with the heel, leg, toe, and sole portions, secures the foot in the boot. To achieve these purposes, in the preferred embodiment, the instep section has a lower section 215 and an upper section 217. The instep portion is of a softer material than the hardened exterior shell, which includes the toe portion 210, heel portion 207, and linking sidewall member 515 (consisting of a left sidewall and a right sidewall to form an exterior skeleton frame for the boot). The spine 249 and cuffs 241 may also be considered a portion of the hardened exterior shell.

The lower instep section 215 provides lateral support, protects the foot, and provides a secure location for the binding connection member to rest when not engaged with the binding. The lower instep section is stiffer than the upper instep section 217. The lower instep section is fixedly attached to the heel cup 219, the toe cup 210, sole 201, and the inner 221 and outer layers 223 of the upper instep section. The lower, more rigid medial and lateral sections of the boot (215 and 217) are semi-rigid and add to lateral stability. The lower instep section also has a portion on which the medial and lateral binding receiving grommets rest when not engaged with the binding. This resting bar 225 has at least one cable guide 227, such as a tunnel, through which the instep strap cable underfoot 229 travels between the instep strap and the grommet 231. The resting bar 225 and binding receiving grommet 233 are configured to consistently present the grommet in the proper position to be grappled by the instep binding grommet hooks 331. The inner layer 221 is a softer layer and provides a barrier between the instep strap and boot lining and the rider's foot. The outer layer 223 provides weather protection (waterproofing, insulation) for the rider Although two layers, or four or more layers, would work and are intended to be covered by the present invention, in the preferred embodiment, the upper instep section 205 has three layers: an inner layer, a instep strap or cable 235, and an outer layer. The inner layer is of a stretchy material to conform to the boot liner and the rider's foot. The upper side of the inner layer should be configured to allow the instep strap to move freely without snagging or resistance against the inner layer.

The upper instep outer layer provides protection against the elements and also protects the foot against impact. The outer layer should be form of a semi-rigid material, such as plastic, and the inner side of the outer layer should be configured to allow the instep underfoot strap 229 (or pair of cables as FIG. 15 shows) to move freely without snagging or resistance against the outer layer. In addition, the outer layer has portals that allow access to a tightening mechanism for the strap (such as a ratchet mechanism 500 of FIGS. 14-21, for example).

The instep strap 235 comprises at least one flexible member that is configured to rest across the instep of the boot and to be similar in elasticity to a conventional snowboard binding instep strap. The strap rests within an envelope between the inner and outer instep layers and is not attached to either the inner or outer layer.

Figure 3:
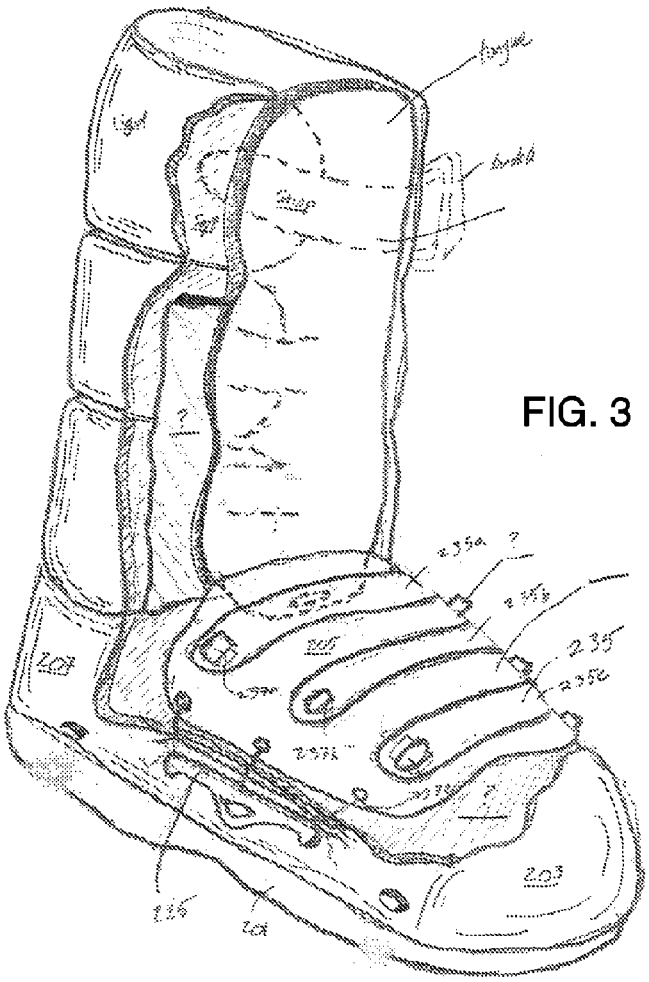
FIG. 3 is a cutaway view of the boot of FIG. 1.

In a preferred embodiment (for example, as FIG. 3 illustrates), the strap 235 comprises multiple flexible members that are configured to rest roughly parallel to one another across the rider's instep, each member comprising a strap (235*a*, 235*b*, 235*c*) and ratchet (237*a*, 237*b*, 237*c*). Or, as in the embodiment of FIGS. 14-21, the instep strap comprises three cables 235*a*, 235*b*, 235*c*, and a single, common ratchet 500. In short, the middle layer comprises multiple ratcheted straps or cables all of which connect to the boot's binding receiving members—grommets. In one variation, each middle layer strap is in its own sleeve within the inner/outer layer envelope, thus preventing the straps from interfering with one another. In yet another variation, the multiple middle layer straps overlap one another within the inner/outer layer envelope, thus, providing independent adjustment that is also connected as a whole by the overlap.

All of the above variations of this instep-tensioning step-in binding have the common advantage of providing the feel and performance of a strap binding with the additional advantage that, once the strap has been adjusted to the rider's desired tension while the boot is engaged in the binding, unlike strap bindings (other than rear entry bindings), no additional adjustment is necessary for the boot's instep strap. In contrast, a conventional strap binding must be adjusted at the beginning of each run. This invention also provides more precise tension adjustment because, rather than a single instep strap adjustment found in conventional strap bindings, as well as rear entry bindings, this invention provides multiple zones of adjustment on the instep through the use of multiple ratchets. Access to adjusting the strap ratchets is through portals in the outer layer of the upper portion of the instep portion.

The medial and lateral ends of the instep strap are fixedly attached to the binding receiving grommets. In the preferred embodiment, this attachment is accomplished using at least one flexible member formed of a material such as steel cable. The strap cable is fixedly attached to the medial and lateral ends of the instep strap, exits the outer layer through portals configured for that purpose, pass through the previously mentioned cable guides in the resting bar, and then fixedly attach to the binding receiving grommets. The binding receiving grommets are formed of a strong, rust resistant material such as stainless steel or titanium. The grommets should be configured to avoid inadvertently snagging or catching the binding grommet hooks. For example, in the disclosed preferred embodiment, the grommets are configured with a curved surface rather than angular surface to aid smooth engagement and disengagement with the grommet hooks.

The heel portion 207 of the boot provides rearward and lateral foot support and protection. In addition, in a preferred embodiment, binding receiving members (heel pegs) 239 are mounted on the heel portion. To achieve these purposes, in the preferred embodiment, the heel portion comprises a heel cup 207 formed of a stiff material that is stiffer than the toe cup 210, such as plastic, and heel pegs 239 of a very strong material such as steel or titanium. The heel cup is fixedly attached to the sole, instep portion, and the leg portion. In the preferred embodiment, there are two heel pegs 239—one mounted on the lateral side of the heel cup and one mounted on the medial side. Although the heel pegs could be mounted by an "arch" similar to the toe pegs and toe pegs arch, in the preferred embodiment, the heel pegs are mounted directly to the heel cup with a flange and screw configuration through corresponding openings in the heel cup, because the greater stiffness of the heel cup, in comparison to the toe cup, is sufficiently strong to accommodate stresses under which the heel pegs 21 will be placed.

The heel pegs 239 are configured to mate with binding heel peg levers 339 on the binding to assist temporarily attaching the boot to the board for riding. Also, when the boot is engaged with the binding, the heel pegs force the boot toe pegs forward against the binding toe hooks, thus assisting to secure the boot in the binding via wedging the boot into the binding between the toe hooks and the heel peg levers. By comparison, this wedging action is accomplished in conventional strap boot/binding configurations by wedging the boot between the binding high-back and the engaged toe strap.

In another embodiment, this purpose may be assisted by so-called "baseless" bindings that precisely fit a boot to a binding. Also, as previously discussed regarding the toe cup, the heel cup may be configured to mate with conventional crampons, including semi automatic and fully automatic crampons.

The heel pegs may also be configured to allow the boot to be coupled with items other than a conventional snowboard. For example, snowshoes and crampons may be specifically configured to mate with the heel pegs and toe pegs configuration of the disclosed boot to securely attach thereto. Another example is with configuring the heel pegs to mate with a binding mechanism for split-boards in ski-mode where the heel may be locked down to allow a randonee skiing experience rather than telemark—a distinct advantage in difficult ski terrain that is not currently available in any split-board binding/boot system.

The leg portion 209 of the boot provides support and protection for a rider's ankle and leg, as well as leverage, feel, and feedback for steering the snowboard. To achieve these purposes, the leg portion comprises a plurality of hard-shell, interlocking and articulating cuffs 241. Each respective cuff consists of a cuff body portion 243 and a tail portion 245. The cuff body portion is fixedly attached to at least the heel portion of the boot. A tongue portion 242 cooperates with each respective cuff portion and is disposed opposite each cuff, adjacent to the cuff's front facing opening. It will be appreciated by those in the art that a single tongue can be used with multiple cuffs and that the tongue enables a rider to place his or her foot inside the boot. The tongue 242 portion is temporarily or fixedly attached to at least the instep portion of the boot. In the preferred embodiment herein disclosed, the cuff portion is fixedly attached to the heel and instep portions of the boot and the tongue portion is fixedly attached to the instep and cuff portions of the boot.

The cuffs should be configured of a semi-rigid material such as plastic. For purposes of this disclosure, a three-cuff version is discussed. However, it is contemplated that a fewer or greater number of cuffs may be implemented to achieve desired flex and support depending on the type of riding anticipated. It is well known in the snowboarding world that shorter or taller boots are beneficial, depending on the desired riding needs. For example, a "freestyle" rider will likely prefer three or fewer cuffs that do not stack as high on the lower leg, thus providing greater flexibility and mobility, while a "free-rider" will likely prefer a cuff configuration with three or more cuffs that stack higher on the rider's lower leg, thus providing greater support and responsiveness.

In the illustrated preferred embodiment having a boot consisting of three cuffs 241, the lower cuff is fixedly attached to the heel cup. The middle cuff is similarly attached to the lower cuff and the top cuff is similarly attached to the middle cuff, thus there is a mechanical coupling between the leg portion 209 of the boot and the heel portion 207. It is contemplated that the attachment of the cuffs to one another and to the heel cup may be achieved by any number of configurations designed by those skilled in the art. In the preferred embodiment, the attachment of the cuffs to one another and to the heel cup is achieved using a flexible material such as woven nylon. In the preferred embodiment, a flexible shell envelops the cuffs and heel cup, each being secured within the shell by suitable means, such as stitching and adhesive. The attachment of such "hard" and "soft" portions of boots is well known in the art of snowboarding, skiing, and footwear generally, and a more detailed discussion of which is beyond the scope of this disclosure. The shell not only serves the purposes of connecting the cuffs and heel cup, but also may be configured to provide additional support and contribute to the flex characteristics of the boot. For example, depending on the stretch and compression characteristics of the shell 28, the shell may contribute to the lean limits for the upper portion of the boot in concert with the spacing of the cuffs in relation to one another and in relation to the heel cup.

The cuffs are adjustably tightened around the leg on the front side of the cuff by ratchet buckle straps 251 fixedly attached to each cuff by suitable means such as tubular rivets. Such ratcheting straps are well known in the footwear art and snowboarding world. In the preferred embodiment, the ratchet buckle straps provide 1/16" increment adjustment or smaller.

Additionally, in snowboarding, the greatest support is required along the rear of the boot (provided by a high back in conventional bindings). In the preferred embodiment, to further assist managing and customizing flex to a rider's desire, the rearward sides of the cuffs, as well as the heel cup, are configured to accept a removable, and interchangeable, spine 249. The spine may be temporarily attached to the boot by any number of suitable means, including multiple latches, multiple tunnel openings 247, and so on, configured to receive the spine.

In the disclosed preferred embodiment, the spine is temporarily attached to the boot with a "T-track" configuration. The rearward portions of the cuffs are configured with a male "T" that is configured to receive the spine that is configured with the corresponding female "T". In the preferred embodiment, the spine is mated with the boot by sliding spine down the "T" track, starting at the top cuff and traveling downward over similar "T"'s on the middle cuff and lower cuffs. In the preferred embodiment, the spine protrudes below the lower cuff, hence, overlapping with the heel cup and providing a limit to rearward motion of the cuffs relative to the heel cup. In comparison, this limit to rearward motion is provided by the "high-back" of a conventional snowboard boot/binding system. The limit of rearward motion, known as "forward lean," may be adjusted by a mechanism on the heel cup 509 that moves a wedge upward between the spine and the heel cup. Such forward lean adjustment mechanisms are well known in the ski and snowboard industry, a detailed discussion of which is beyond the scope of this disclosure.

The spine insert 512 is secured from inadvertent release. In other embodiments, for example as FIGS. 14-21 illustrate, the spine 249 consists of a plurality of interlocking cuffs 241, which may have increased stiffness by means of an increased thickness overlapping portion 516 (as in FIG. 21, for example) or overlapping inverted T-shaped cuffs (as in FIG. 4, for example). The spine is formed a semi-flexible material that may be configured to provide specific flex characteristics, including limited rearward and lateral motion with greater forward flex. Materials suitable for the spine member include plastic, fiberglass, and, preferably, carbon fiber. It is contemplated that a variety of spines with a variety of different flex characteristics may be manufactured to provide a rider with a variety of choices to suit the rider's desired ride quality.

In an alternative embodiment, as FIGS. 4 and 4*a* illustrate, to aid in providing added rear support (the function served by a conventional "high-back"), the rearward portion of the cuffs have a member 514 that protrudes downward, overlapping the cuff 241 below. When the boot is flexed rearward, these "tails" provide a limit to rearward flex. The angle that results is known as the "forward lean." Forward lean is adjusted by a mechanism on the heel cup that moves a wedge upward between the lower cuff tail and the heel cup. Additionally, a selectively insertable spine component 512 adapts to mechanically interconnect the stacked cuff portions and further reduce flex. The spine member is comprised of a stiffer material, and or of a geometry that results in greater resistance to bending. For example, the spine member could be stainless steel, or any other metal or alloy. Alternatively, the spine member could be a plastic with a geometry designed to reduce flex along the long, vertical axis of the spine. (And, as in the embodiment illustrated in FIGS. 14-21, for example, the spine may alternatively consist of double-layered material that overlaps to increase stiffness without the use of an additional insert or cable such as a series of articulating cuffs 241 with an overlapping portion 516).

The tongue portion of the leg portion may be temporarily or fixedly attached to the instep section. For this invention, an interchangeable tongue is desirable because it provides an additional means to customize flex to the rider's individual desire. Interchangeable footwear tongues are well known in the art and footwear world. In the preferred embodiment, the tongue is temporarily attached to the instep section via suitable means, such as a hook-in method.

In a preferred embodiment of the present invention a binding 30 comprises three main portions: a disc portion 301, a frame portion 303, and a boot-coupling portion 305. FIG. 2, for example, illustrates a possible binding according to this preferred embodiment. And, FIG. 9, for example, illustrates a pair of bindings according to the present invention mounted on a snowboard having a pair of boots coupled to the bindings.

The disc portion provides the holes for screws (or other suitable fasteners, as would be well-appreciated by those skilled in the art) to temporarily fixedly attach the binding, and thus, the boot and the rider, to a snowboard. In addition, the disc portion is configured to couple with the frame portion at a variety of angles to permit the rider to choose desired angles of the binding in relation to the board. Such a disc with holes to accommodate screws and with an outer edge configured to accommodate a variety of boot housing angles is widely known in the art and in the world of snowboarding. Here, the disc may be configured to accommodate any number of hole-configurations for mating with snowboards. However, in the preferred embodiment, the disc is configured to accommodate the generally universal four-screw pattern for mating with a wide variety of makes and models of snowboards.

The frame portion 303 of the binding is configured to receive a snowboard boot, to mate with the disc portion, to have the boot-coupling portion fixedly attached thereto, and to have handles fixedly attached thereto. The frame portion is also configured to provide additional surface area around the disc to provide the rider with additional stability, feel, and leverage for steering the snowboard.

The frame portion 303 may be formed of a variety of strong, semi-rigid materials that provide controlled flex, such as steel, titanium, fiberglass, plastic, or carbon fiber, for example. The toe-coupling member should be formed of a rigid, durable material, such as steel or titanium, to withstand repeated friction against the boot-coupling members. In the disclosed preferred embodiment, the frame portion is formed of carbon fiber, to take advantage of its light-weight and flex characteristics. Those skilled in the art may employ a variety of weight-saving and strengthening structures as part of the frame, such as struts and triangle lattices.

The boot-coupling portion 305 of the binding is configured to receive the boot instep and toe-binding members. In so receiving, the boot-coupling portion provides mechanical advantage to provide the desired hands-free, true "step-in" binding convenience. It is understood that, given the disclosures herein, alternative mechanical configurations to achieve the covered invention—a step-in binding with tension across the rider's instep, which has not previously been achieved—may be created by those skilled in the art. Accordingly, this invention is not limited to the particular mechanical device disclose herein; instead, the scope of the mechanical portion of this invention is intended to cover any mechanical advantage that allows a hands-free step-in binding with engagement of an instep portion of the boot to provide tension across the instep of the rider's foot when coupled with the binding.

Making specific reference to FIGS. 5, 6, 7, and 8, which illustrate a preferred embodiment of the binding system according to the present invention, as a rider steps onto the binding system with the boot 20, the two toehooks 311 engage the front two hooks protruding from either (medial and lateral) side of the boot. As the heel portion rotates downward, the heel hooks (on the boot on both the medial and lateral sides) engage a lever arm, such as heel lever 315, which is configured and situated to rotate downward and toward the toe pegs 211. Thus, when engaged by the heel peg 239, the heel lever end mates with the heel peg and moves the binding system to cinch the boot between the toe pegs and heel pegs. In turn, this motion by a mechanical transfer along a lever arm and biasing member sub-assembly cause the grappling hooks 317 to move inward and engage the tow bar 225 coupled to the boot, thus tightening the straps on the boot and simultaneously locking in the boot to the binding by engaging a latch lock cam 319 and pawl. Thus, the boot can have a soft sole for the feel demanded by riders, but still provide some camming to avoid play in the boot.

The latch lock selectively releases by the rider by when the rider yanks upwardly on an associated handle connected by cables to the latch lock pawl (FIG. 10 illustrates this handle and release mechanism.) As detailed in FIGS. 10, 11, and 12, the release mechanism integrates with the binding sub-assembly of FIGS. 6-8 to enable the rider to unlock the binding as needed.

The preferred embodiment of the boot-coupling portion 305 comprises boot engagement portion 307 and a boot release 309 portion. The boot engagement portion comprises a housing 313, a boot heel peg receiving lever 315, a boot instep grommet-receiving lever 317, a ratchet wheel 319, a ratchet pawl 321, a coupling axle 323, an axle arm 325, and a cable 327 and pulley 329 linking the grommet-receiving lever to the axle arm. At least one torsion spring is situated on the axle that tends to drive heel peg lever upward.

FIG. 7, a top view of the binding system, and FIG. 8 a cross-sectional frontal view of the binding system, showing the boot in hidden lines, better illustrate the components and functioning of the binding. A rotatable plate 301 couples to the board surface, as would be well-understood in the art to enable the binding to selectively rotate to a position that is comfortable for the individual rider. A medial and lateral instep lever 317 selectively rotate inward as the boot is pressed downward atop the binding. The inward rotation causes a hook-like end of the respective medial and lateral lever 317 to engage the corresponding medial and lateral resting bar 225. This is accomplished by redirecting the motion, weight, and downward movement of the rider's heel as it comes in contact with the heel portion of the binding.

The heel lever is situated to be parallel to the boot (toe to heel) and the heel axle should be perpendicular to the boot (toe to heel). The instep lever is situated to rotate down and away from the boot. The instep lever may be offset from the rest of the coupling mechanism. Accordingly, a second pulley may be required. The pulleys **329*a* and 329*b* are coupled to the frame with rivets, the first pulley 329*a* is situated within a housing. The cable 327 between the two pulleys travels through a tunnel configured and situated in the frame 303 to guide the second pulley cable. The frame is also configured with a portal to allow the cable to travel from the second pulley 329*b* to the instep arm 317. Thus, the cable is threaded through the opening in the axle arm, then through the first pulley, then through the tunnel, then through the second pulley, then the portal in the frame, then through the opening in the instep lever, and is finally secured at both ends with toppers. Although this specific configuration will work, this invention contemplates other arrangements of components and mechanisms that transfer the downward rotation of the heel of the boot to a cinching operation on the bar 225** to hold the boot fast against the binding, and yet enable the boot to have a soft sole for feel when snowboarding. As such, other arrangements or combinations of gears, cams, pulleys, levers, springs, ramps, axles, fasteners, wedges, etc. can be designed to achieve this same functionality of the discussed mechanism.

The heel lever and axle are configured to mate such that the lever rotates with the axle like a second-hand on a clock. The ratchet wheel is attached toward the lateral end of the axle in a similar fashion. The axle arm is configured to slide onto the axle in a fixed position on the axle. A strut supporting the axle is configured to receive one end of the torsion spring and the heel peg lever is configured to receive the other end of the torsion spring. The axle is inserted into openings in the frame, the axle arm, torsion spring, heel peg lever, and ratchet wheel are placed on the axle, and end screws secure the axle to the frame.

A cable or other mechanical linkage (such as a lever, ratchet mechanism and the like) links the axle arm to the instep lever. The axle arm has an opening through which the cable is threaded and the end thereof is secured to the axle arm with a stopper. Such cable stoppers are well known in the cable art; for example, bicycle brake and derailleur cables employ such stoppers. The instep lever is similarly configured to receive the other end of the cable. A pulley is situated and configured on the frame to change the direction of the cable. The pulley is fixedly attached to the frame with rivets. Thus, the cable is threaded through the opening in the axle arm, then through pulley, then through the opening in the instep lever, and is secured at both ends with stoppers.

A torsion spring tends to drive the instep lever toward the boot. The frame is configured to receive one end of the torsion spring and the instep lever is configured to receive the other end of the torsion spring. The instep lever pivot end is configured as a "T" and the frame is configured to receive the T and permit the lever to rotate. The torsion spring is secured to one end of the "T" of the instep lever, which is fixedly attached to the frame with a plate and screw. The ratchet wheel has a single tooth configured to receive the ratchet pawl. These elements of the boot-coupling portion are situated on both the medial and lateral sides of the boot as mirrored elements.

Of course, when there is no boot in the heel-portion of the binding, the binding mechanism is designed by spring tension to open.

The release portion comprises ratchet pawls, release axle with torsion springs, a cable, a pulley, a handle base, and a handle. The ratchet pawls for both sides are linked with an axle that travels under the boot. This "duel" pawl and axle is formed as a single element of a strong, durable material such as steel or titanium. The frame is configured to permit the pawls to enter through openings in the frame like the instep lever. The pawl axle is secured to the frame with screws in a similar fashion as the coupling axle. In addition, like the instep lever, a torsion spring is attached to each pawl, tending to drive the pawls toward the ratchet wheels.

The pawls are configured to mate with the ratchet wheels. Additional release elements are situated on the lateral side of the boot that enable the rider to manually release the binding from the boot, and to reset the binding to receive the boot again. The lateral ratchet pawl is configured to receive and secure a release cable. In addition, the lateral ratchet pawl is formed with an arm extending rearward that is configured to be blocked by the release handle gate when the gate is the closed position, and to enter the release handle gate when the gate is in the open position.

The release cable travels through a pulley, fixedly attached to the frame with a rivet, rearward of the pawl, changing the direction of travel of the cable from rearward to upward toward the release handle. The cable is secured to the release handle in a "free floating" manner such that the cable is not twisted while the handle is rotated on a horizontal plane. This is achieved by securely attaching the cable to the handle with a choke type of connection in which the cable travels through an opening in the handle, and on the upper side is attached to a larger block. Here, that larger block is a circular plate on the horizontal plane that is configured to fixedly attach to the cable but is larger than the opening through which the cable traveled. The circular plate rests in a cylindrical pocket in the handle, thus permitting it, and the cable, not to rotate when the handle is rotated.

The housing is configured with an opening that is configured to accept the cable tunnel and cable tunnel locking screws. The cable tunnel is formed of a ridge material, such as plastic, and comprises an upper and lower portion. The upper and lower cable tunnel portions are configured to screw together securely with the housing sandwiched between flanges on both portions. In addition, the upper and lower cable tunnel portions are configured with corresponding openings that accept two screws to fixedly attach the upper and lower cable tunnel portions together.

The upper cable tunnel portion is configured with two "L" arms that prevent the handle from upward motion when the cable is pulled taught when ratchet pawl is engaged into the tooth in the ratchet wheel. In addition, the upper cable tunnel portion is configured with two ramps that guide the release handle back down toward and then under the locking arms when the release cable is pulled by the ratchet pawl into the "ready" position against the ratchet wheel, but not yet fully engaged with the ratchet wheel tooth in the "locked" position. The ramps are positioned across from one another as are the screw accepting female portions configured to mate with screws for securing a lid. The ramps and L arms on the left boot binding are configured to require counter-clockwise rotation to permit the cable to be pulled upward while the right boot binding ramps and L arms are configured to require clockwise rotation to permit the cable to be pulled upward for the ease and convenience of the rider. The lid is configured with 3 holes: a center hole for the cable and two holes for screws to securely fix the lid to the body of the upper cable portion.

The release handle comprises two portions configured to mate together securely with corresponding male and female portions and an additional securing screw. When mated, the halves securely contain the plate end of the release cable previously discussed. The lower portion of the handle includes two members configured to mate with the L arms. The release handle is formed of a rigid material, such as plastic, with the surfaced textured to assist the rider to grip the handle.

Binding handles are fixedly attached to the lateral and medial sides of the binding frame with screws. The binding handles are formed of a rigid material such as plastic, aluminum, steel, fiberglass or carbon fiber. The binding handles are configured to accept the rider's hands to assist engaging the binding mechanism when standing on a firm surface is not practicable, such as in deep powder.

Although the disclosed preferred embodiment is for step-in snowboard boot and binding, many aspects of this invention may be used in conventional snowboard boots, split-boarding (touring snowboard), and any sliding sport. In addition, some aspects have broader application. For example, the disclosed articulated cuff or spine may be used in most any boot system in which controlling flex is desirable. In addition, the toe pegs attaching to hooks may be used in a "hybrid" step-in boot where there is a conventional instep strap plus the toe hooks. A further variant would be a conventional strap and/or toe hooks and/or spine and/or tails, and/or articulated cuffs, or any combination thereof. Similarly, no current boot/binding integrates the instep strap with the boot itself (as opposed to merely attaching an external strap to an otherwise conventional type snowboard as numerous manufacturers have done in efforts to make step-in boot/binding systems).

In addition, most of the elements of this invention serve more than one purpose; the present invention is not intended to cover those elements only in their multiplicity. For example, the heel lever has many purposes. Its movement engages the binding mechanisms, it provides forward force against the toe hooks, and it provides lateral support (thus "substituting in part" for the conventional medial and lateral binding members). The present invention is intended to cover all such variations and applications of the many new aspects of this invention.

Another example is the middle layer of the upper portion of the instep portion of the disclosed snowboard boot. A variation of the middle layer may easily be adapted to conventional strap bindings. For example, a conventional instep strap may be configured to incorporate the disclosed multiple ratchets and straps connected together, with a fixed connection point on the medial side of the binding and a single connection point on the lateral (or vice versa) to keep the convenience at the same level of a traditional strap binding. The single connection point may be similar to a ski buckle, but with a single rather than multiple hooking points since the adjustments for length are via multiple ratchets on the strap. Yet another adaptation may use the "bolo" tensioning system now used on some snowboard boot lacing systems to manage the instep strap tension, but substituting the toe pegs for the conventional toe strap. Yet another example is the snowboard boot specific shank that runs along the edges of the sole rather than down the middle, thus allowing step-in crampon compatibility yet maintain soft board feel while riding. This edges-rather-than-midline-shank may be adapted to any snowboard boot, and such adaptation is contemplated by the present invention.

The binding handles, of course, may be adapted to any step-in binding to improve the speed and ease of engaging the boot into the binding, especially when stepping-in is difficult, such as in deep powder.

In an alternative embodiment, the release mechanism comprises ratchet pawls, a release cable, a pulley, a compression spring, a disk, a torsion spring, a release handle, and a binding housing. The lateral ratchet pawl 321 configures to receive and secure a release cable. A pulley locates on the frame 303 to change the direction of the release cable toward the handle. The release cable travels from the ratchet pawl, through the pulley, and is coupled to the steel disk. The disk is coupled to the release handle in a free-floating manner by a suitable means, such as a rivet, such that the cable is not twisted when the release handle is rotated. A torsion spring is coupled to the steel disk and the release handle, causing rotation of a numb on the release handle toward the locked position in the housing.

To release the boot, the rider must rotate the release handle numb to the release position in the housing and then pull the handle upward, thus pulling the ratchet pawl away from the ratchet wheel/cam, allowing the torsion springs in the coupling mechanism to aid the rider's removal of the boot from the binding. When the rider lets go of the release handle, the pawl torsion spring and handle numb clear the release position vertical shaft, the release handle torsion spring then rotates the release handle num into the locked position on the housing: Hence, the release handle is configured and situated to rest in the locked position, thus aiding in avoiding an unintended release of the boot from the binding.

Another preferred embodiment of a boot and binding system according to the present invention, as FIGS. 14-21 illustrate, for example, contemplates a soft soled boot with a step in binding. Many aspects of this embodiment are similar or identical to the elements and descriptions of the previous embodiments discussed above herein and those details are not repeated except as needed to explain or better appreciate nuances of this preferred embodiment. Accordingly, the boot employs boot toe pegs 211, medially and laterally, that pivot against binding toe hooks 311 when stepping down into the binding toward the heel to engage an instep coupler integrated into the boot. The stepping action engages the instep coupler via boot heel pegs 239 that mate with binding heel levers 315. At the point when the boot sole 201 is slightly compressed against the binding base plate 303, the instep coupler is fully engaged, thus creating tension across the instep of the rider's foot via instep cable straps underfoot 229 in the boot similar to a conventional strap boot/binding system. The stepping action also "cocks" the release mechanism. To exit the binding, the rider "yanks" up on a release handle that has a safety measure to avoid inadvertent release, causing the binding grappling hook 317 to tend away from the instep coupler grommet 231 thus allowing the boot 20 to disengage from the binding.

Other aspects of this embodiment of the invention include, for example, a hardened exterior shell material—toe cup 210 having integrated front toe pegs 211. The instep strap actually consists of three generally parallel cables 235*a*, 235*b*, and 235*c* linked to a common ratchet mechanism 500. Each cable has a first end coupled to a large cable nut 501 for rough adjustment of tension and cable length and on the opposite end a small cable nut 503 for more precise adjustment of cable length and tension. The binding 30 includes a baseplate 505, which adapts to mount to a snowboard. The baseplate 505 may be integral to the binding 30 or may be coupled to the binding 30 in a conventional manner.

The boot 20 includes a soft material, such as neoprene or other textile, as would be appreciated by those skilled in this art, on the upper 523 and interior portion that contacts the wearer's foot. Other portions of the boot, such as the front portion 521 along with the rigid material of the toe cup 201, heel cup 207, instep portion 205, side portion 515 include a harder material such as polyethylene, nylon, ABS, and Delrin. The binding 30 is fabricated, molded or otherwise made of a metal, alloy of metal or composite, for example, aluminum—If die cast, then 356-T6 or if 6061-T6 would be good as well. Other components, such as high-stress parts, fasteners, grommets, etc., can be made from stainless steel or other materials common in this art.

Split-Board Application.

FIG. 13 illustrates a possible split-board system that incorporates the binding system and boots of the present invention. Thus, the preferred embodiment of the present invention—ideally suited for snowboards—readily adapts for split-boarding. Thus, in a second preferred embodiment, the binding system is modified slightly for split boards, but the boot design, as previously disclosed, remains unchanged.

Although a snowboard requires a front binding and a back binding, split boarding needs a binding that will act as a left binding and a right binding when the board is split, and a front binding and back binding pair when the split board is joined together. The present binding system can readily be adapted for this dual role where the binding adapts for skinning (ski mode) and one for riding back down (ride mode). The current art (such as the binding designs disclosed by Voile) require an interface to attach a snowboard boot to the binding used for skinning.

This current art interface is heavy, awkward, raises the boot away from the board, thus reducing control of the board, and places the pivot point for skinning in the wrong location—ideally skinning requires a similar binding mounting point more like telemark boots—and the current art cannot accommodate this position.

The present invention overcomes the limitations of the current art and solves the aforementioned problems. Specifically, the existing toe pegs 211 are utilized as pivot points for the boot when in the skinning split-board configuration. As discussed herein, the toe pegs 211 provide an attachment point for coupling to the binding disclosed herein for use with a conventional snowboard. These same toe peg 211 provide the boot coupling and pivot point for the ski binding portion of the split board thus obviating the need for an interface altogether. This weight savings and proper placement o the pegs as a pivot point for skinning are desired improvements in split boarding.

The ski mode binding to couple the boot 20 to the split-board is a simple clamping device similar to a cross-country ski binding. A closer current art device is the Dynafit randonee brand binding (which is well understood in the art) that clamps onto concave points on the boot. Similarly, the present invention includes a modification to the binding system to cup and clamp the toe pegs 211 with sufficient strength to hold the boot in place while skinning. The cup designed to hold the boot, but configured and situated to allow the toe pegs to pivot within the cups thus permitting the rider to "skin" up the mountain.

The ride mode binding is identical to the disclosed binding herein except that it would be "split" with toe pegs on one half and the coupling and release mechanism on the other. The split-board iteration of the binding also has an added element to stabilize the binding under the boot and also assist in coupling the two halves of the split-board. In the preferred embodiment, this element is similar to the "bolt action" of a simple gate lock that may be manually and quickly engaged and disengaged by the rider. This element may be achieved in any number of ways and the disclosed version is only one—this invention is intended to cover all such stabling/connecting elements for the disclosed binding being adapted to a split-board. The split-board iteration would also require a different disc with a different hole-pattern (two per binding instead of one, so 4 total) due to the split-nature of the board.

FIG. 13 illustrates a contemplated split board device according to this second preferred embodiment of the present invention. Accordingly, when the split board is joined together, the split board functions as a snow board according to the first preferred embodiment, previously discussed herein with the left and right bindings functioning as already explained. But—as FIG. 13 shows—when the split board is in ski mode, there is a ski-mode binding on each half of the board. Thus, there is a left and right "ski" and each ski has its own respective ski-mode binding comprising a toe cup adapted to engage the toe hook mounts of the left and right boots, respectively. Because in the split mode, the heel of the boot need not be attached to the board—in fact the boot heel cannot be attached for proper technique—there is no need for a heel-engaging or rear binding.

Although the invention has been particularly shown and described with reference to certain embodiments, it will be understood by those skilled in the art that various changes in form and detail may be made without departing from the spirit and scope of the invention.

I claim:

1. A system comprising:

a binding; and a boot adapted to selectively engage the binding, the boot further comprising a soft sole coupled to a hardened exterior shell, the hardened exterior shell comprising a toe portion and a heel portion linked by a sidewall portion, the toe portion comprising a left side toe peg and a right side toe peg, the heel portion comprising a left side heel peg and a right side heel peg, the boot further comprising an instep portion arranged adjacent to the toe portion, and a resting bar arranged adjacent to the instep portion, the resting bar guiding an instep strap or an instep cable; and the binding further comprising a base plate supporting a first toe hook adapted to selectively engage the left side toe peg and a second toe hook adapted to selectively engage the right side toe peg, a left heel peg lever adapted to releasably engage the left side heel peg and a right heel peg lever adapted to releasably engage the right side heel peg, and a grappling hook coupled to a baseplate and adapted to selectively engage the resting bar.

2. The system of claim 1, further comprising:

a second grappling hook disposed on a side of the baseplate opposite the first grappling hook and connected by a underfoot cable to a ratchet mechanism; and a second resting bar disposed on the boot opposite the first resting bar and guiding an opposite end of the instep strap or the instep cable.

3. The system of claim 1, wherein the boot further comprises a spine coupled to the heel portion.

4. The system of claim 1, wherein the instep strap or the instep cable comprises a first instep cable, a second instep cable, and a third instep cable, the instep cable having a first end with a large cable nut and a second end with a small cable nut.

5. The system of claim 1, wherein the hardened exterior shell of the boot further comprises a cuff portion coupled to the heel portion, the cuff portion comprising a hardened material.

6. The boot of claim 5, further comprising a plurality of cuffs arranged to form an upright of the boot, each of the plurality of cuffs being coupled to its immediate adjacent cuff, the plurality of cuffs further comprising a spine portion.

7. The binding of claim 1, further comprising a ratchet mechanism coupled to the baseplate and adapted for selective engagement of the grappling hook to the resting bar.

8. The system of claim 1, further comprising a snowboard coupled to the binding.

9. The system of claim 1, further comprising a splitboard coupled to the binding.

10. The system of claim 1, further comprising a ski coupled to the binding.

11. A device comprising:

a baseplate supporting a first toe hook and a second toe hook opposite the first toe hook on a front portion of the baseplate;

a soft sole coupled to a hardened exterior shell, the hardened exterior shell comprising:

a toe portion comprising a left side toe peg and a right side toe peg;

a heel portion comprising a left heel peg lever coupled on a rear portion of the baseplate and a right heel peg lever coupled on a the rear portion opposite to the left heel peg lever, the toe portion and the heel portion linked by a sidewall portion;

a cuff portion coupled to the heel portion, the cuff portion comprising a hardened material; and a grappling hook pivotably mounted to the baseplate, the grappling hook further comprising a ratchet mechanism.

12. An apparatus comprising:

a soft sole coupled to a hardened exterior shell, the hardened exterior shell comprising a toe portion and a heel portion linked by a sidewall portion, the toe portion comprising a left side toe peg and a right side toe peg, the heel portion comprising a left side heel peg and a right side heel peg;

an instep portion arranged adjacent to the toe portion and a resting bar arranged adjacent to the instep portion, the resting bar guiding an instep strap or an instep cable; and a cuff portion coupled to the heel portion, the cuff portion comprising a hardened material.

* * * * *